US005756163A

United States Patent [19]

Watanabe

[11] Patent Number: 5,756,163

[45] Date of Patent: May 26, 1998

[54] COATING DEVICE AND A METHOD OF COATING

[75] Inventor: Masaru Watanabe, Nishinomiya, Japan

[73] Assignee: Matsushita Electric Industrial Co., Ltd., Kadoma, Japan

[21] Appl. No.: 744,999

[22] Filed: Nov. 7, 1996

Related U.S. Application Data

[62] Division of Ser. No. 509,166, Jul. 31, 1995.

[30] Foreign Application Priority Data

Aug. 3, 1994 [JP] Japan ..... 6-182289

[51] Int. Cl.[6] ..... B05D 1/02; B05D 1/18; B05C 3/02

[52] U.S. Cl. ..... 427/430.1; 427/421; 427/286; 118/410; 118/411; 118/412; 118/415; 118/419; 118/DIG. 2

[58] Field of Search ..... 427/421, 430.1, 427/286; 118/410, 411, 412, 415, 419, DIG. 2

[56] References Cited

U.S. PATENT DOCUMENTS 4,687,137 8/1987 Boger et al. .
4,844,004 7/1989 Hadzimihalis et al. .
4,874,451 10/1989 Boger et al. .
4,886,013 12/1989 Turner et al. .
5,145,528 9/1992 Watanabe et al. ..... 118/411
5,318,804 6/1994 Yoshida .
5,348,768 9/1994 Shibata et al. ..... 118/410

FOREIGN PATENT DOCUMENTS 62-266157 11/1987 Japan .
5-11105 1/1993 Japan .

*Primary Examiner*—Shrive P. Beck
*Assistant Examiner*—Bret Chen
*Attorney, Agent, or Firm*—Renner, Otto, Boisselle & Sklar, P.L.L.

[57] ABSTRACT

In a coating device, a nozzle is configured by combining a front block and at least one back block. A front block includes a portion which is projected toward the base member with respect to the back block, and a top face of the projected portion is processed into a curved face having a predetermined curvature radius. A top face of the back block, which is opposed to the base material, is processed into a flat face, and a plurality of discharging openings are provided therein for discharging a coating material therethrough. The base material first travels along the curved face of the front block. The base member then travels over the flat face of the back block substantially in parallel with the flat face, while the coating material is discharged through the discharging openings, thus forming a stripe-shaped coating film on the surface of the base material. A line width and a thickness of the thus formed stripe-shape coating film is controlled to stay at designed values and fluctuation thereof are eliminated.

6 Claims, 20 Drawing Sheets

COATING DEVICE AND A METHOD OF COATING

This is a division of copending application Ser. No. 08/509,166, filed Jul. 31, 1995.

BACKGROUND OF THE INVENTION

1. Field of the Invention

The present invention relates to a coating device for applying one or more kinds of coating materials on a base material so as to form a coating film having a predetermined stripe pattern, and a method for such coating. In particular, the present invention relates to a coating device for forming stripe-patterned coating films used in the field of electronic parts, e.g., color filters for liquid crystal display devices and electrode patterns for multilayered ceramic chip capacitors, and a method for such coating.

2. Description of the Related Art

The production of electronic parts can require a step of applying a coating material in a stripe pattern on a relatively soft base material. Hereinafter, the term "coating material" is used to collectively refer to materials to be applied such as a paint, an adhesive and the like.

For example, in the case of a color filter used for liquid crystal displays; pixels of red, blue, and green are provided in a stripe shape on transparent glass serving as a base material. Known conventional methods for producing such color filters include a dye method, a pigment scattering method, a printing method, an electrocoating method, and the like. However, these methods all require complicated processes and therefore hinder the reduction in the production cost of color filters.

Japanese Laid-Open Patent Publication No. 5-11105 discloses an exemplary method of producing a color filter. According to this method, different dies are prepared for the respective colors of paints to be applied. Each die has a plurality of slits formed therein. A paint of a given color (e.g., red) is extruded through each of the plurality of slits so as to be applied on glass in a stripe shape.

A coating device for applying a coating material such as adhesives on a base material in a stripe pattern is disclosed in, for example, Japanese Laid-Open Patent Publication No. 62-266157.

The above-mentioned Japanese Laid-Open Patent Publication No. 5-11105 fails to disclose features relating to the structure of a die or the shape of a tip portion thereof. Accordingly, the publication fails to make clear the preferable configuration of a die required to securely form each stripe while eliminating the fluctuation of line width on the order of micrometers in the case of forming very a minute stripe pattern.

In accordance with the coating device disclosed in Japanese Laid-Open Patent Publication No. 62-266157, a plurality of orifices are provided at a tip portion of a nozzle; adhesive beads are formed between a base material and the orifices, thereby applying an adhesive in a stripe shape. However, the sizes of the plurality of beads must be uniform in order to secure that the resultant stripes have the same line width.

Therefore, with the device or method disclosed in either one of the above publications, it is difficult to accurately control the line widths of the stripes of the coating film to be formed by application.

Furthermore, the device or method in either publications functions in such a manner that a coating material which is extruded through an application head (such as a die) is pressed so as to spread across along the width direction of the base material in an interspace between the base material and the application head. According to research by the present inventor, in the case where a coating material is applied by using a die provided with slits having a width of 100 μm, the line widths of the stripes of the coating film which is actually formed on the base material tend to be typically in a range of 110 μm to 150 μm with a large fluctuation, as a result of the coating material spreading along the width direction of the base material after being extruded through the slits.

The inventor also has found that the interspace between the base material and the application head must always be kept constant in order to prevent pressure of the coating material in the interspace from fluctuating, which would result in the fluctuation in the line width of the resultant coating film.

As described above, the line widths of the stripes of the coating film formed by conventional techniques may fluctuate on the order of several dozen μm. Such inaccurate stripe patterns, including such a large fluctuation in the line width, cannot be satisfactory for the use in the electronics field, for example, as a color filter, and may possibly fatally undermine the performance of the product.

It is also difficult, according to conventional techniques, to accurately control the thickness of the coating film so as to prevent any fluctuation.

SUMMARY OF THE INVENTION

According to one aspect of the invention, a coating device for forming a coating film in a predetermined pattern by applying a coating material from a nozzle to a surface of a base material which continuously travels is provided. The nozzle includes: a front block provided upstream with respect to a traveling direction of the base material, a top face of the front block opposing to the traveling base material being a curved face which has a predetermined curvature radius; and a back block provided downstream with respect to the traveling direction of the base material, a top face of the back block opposing to the traveling base material being a flat face. The front block is provided so as to project toward the base material with respect to the back block, and a plurality of discharging openings are provided on the flat face of the back block for discharging the coating material therethrough.

In one embodiment, the front block includes a slit for discharging a first coating material therethrough, the slit extending continuously in a width direction of the base material, and the coating material discharged through the plurality of discharging openings of the back block is a second coating material to be applied on a coating film of the first coating material.

In another embodiment, the base material travels with respect to the flat face of the back block at an angle in the range of ±10°. Preferably, the base material travels substantially in parallel with the flat face of the back block.

In still another embodiment, the curvature radius of the curved face of the front block is in the range from 3 mm to 300 mm.

In still another embodiment, a distance between the traveling base material and the flat face of the back block is in the range from 1 μm to 200 μm.

In still another embodiment, a distance X1 from an end face of the front block, which is closer to the back block, to a nearest brim of each of the plurality of discharging openings is in the range from 0.005 mm to 10 mm.

In still another embodiment, a distance X2 from a far end of the back block from the front block to a nearest brim of each of the plurality of discharging openings is in the range from 0.1 mm to 10 mm.

In still another embodiment, the back block includes in the interior thereof: a manifold; a slit provided from the manifold through the flat face, the slit extending continuously in a width direction of the base material; and a plurality of apertures each running from the slit to the flat face, each of the plurality of apertures corresponding to each of the plurality of discharging openings.

In still another embodiment, the plurality of discharging openings provided on the flat face of the back block include a first discharging opening for discharging a first coating material therethrough, a second discharging opening for discharging a second coating material therethrough, and a third discharging opening for discharging a third coating material therethrough.

In still another embodiment, the back block is configured by combining a plurality of sub-blocks.

According to another aspect of the invention, a coating device for forming a coating film in a predetermined pattern by applying a coating material from a nozzle to a surface of a base material which continuously travels is provided. The nozzle includes: a front block provided upstream with respect to a traveling direction of the base material, a top face of the front block opposing to the traveling base material being a curved face which has a predetermined curvature radius, the front block including a slit extending continuously in a width direction of the base material and discharging a first coating material therethrough; and a back block provided downstream with respect to the traveling direction of the base material, a top face of the back block opposing to the traveling base material being a flat face, a plurality of discharging openings being provided on the flat face for discharging a second coating material therethrough. The base material travels, above the front block, along the curved face while retaining a predetermined distance between the curved face and the base material, and travels over the back block at an angle in the range of ±10° with respect to the flat face of the back block, and the second coating material discharged through the plurality of discharging openings of the back block is applied on a first coating film of the first coating material to form a second coating film.

In one embodiment, the base material travels substantially in parallel with the flat face of the back block.

According to still another aspect of the invention, a coating device for forming a coating film in a predetermined pattern by applying a coating material to a surface of a base material which continuously travels is provided. The device includes: a nozzle having a flat face on which a plurality of discharging openings are provided for discharging the coating material therethrough; and a backup member disposed substantially in parallel with the flat face, the backup member supporting the traveling base member. A length X3 of a base-material travelling region of the flat face and a length X4 of a base-material travelling region of the backup member satisfy the relationship of $X4 \geqq X3$.

According to still another aspect of the invention, a method for forming a coating film in a predetermined pattern by applying a coating material from a nozzle to a surface of a base material which continuously travels is provided. The nozzle includes: a front block provided upstream with respect to a traveling direction of the base material, a top face of the front block opposing to the traveling base material being a curved face which has a predetermined curvature radius; and a back block provided downstream with respect to the traveling direction of the base material, a top face of the back block opposing to the traveling base material being a flat face, wherein the front block is provided so as to project toward the base material with respect to the back block, and a plurality of discharging openings are provided on the flat face of the back block for discharging the coating material therethrough. The method includes the steps of: making the base member travel along the curved face of the front block; making the base member travel over the flat face of the back block at an angle in the range of ±10° with respect to the flat face; and discharging the coating material through the plurality of discharging openings so as to apply the coating material on the base material without contacting the coating material with the front block.

In one embodiment, the method further includes the step of discharging a first coating material through a slit provided in the front block to form a first coating film, wherein in the step of discharging the coating material through the plurality of discharging openings, a second coating film is formed on the first coating film.

In another embodiment, the base material travels substantially in parallel with the flat face of the back block.

In still another embodiment, the plurality of discharging openings provided on the flat face of the back block include a first through third discharge openings. In the step of discharging the coating material through the plurality of discharging openings, a first coating material is discharged through the first discharging opening, a second coating material is discharged through the second discharging opening and a third coating material is discharged through the third discharging opening so as to form a first through third coating films on the surface of the base material.

According to still another aspect of the invention, a method for forming a coating film in a predetermined pattern by applying a coating material from a nozzle to a surface of a base material which continuously travels is provided. The nozzle includes: a front block provided upstream with respect to a traveling direction of the base material, a top face of the front block opposing to the traveling base material being a curved face which has a predetermined curvature radius, the front block including a slit extending continuously in a width direction of the base material and discharging a first coating material therethrough; and a back block provided downstream with respect to the traveling direction of the base material, a top face of the back block opposing to the traveling base material being a flat face, a plurality of discharging openings being provided on the flat face for discharging a second coating material therethrough. The method includes the steps of: making the base material travel, above the front block, along the curved face of the front block while retaining a predetermined distance between the base material and the curved face, and discharging the first coating material through the slit provided in the front block to form a first coating film; making the base material travel over the back block at an angle in the range of ±10° with respect to the flat face of the back block; and discharging the second coating material through the plurality of discharging openings to form a second coating film on the first coating film.

In one embodiment, the base member travels substantially in parallel with the flat face of the back block.

Thus, the invention described herein makes possible the advantages of (1) providing a coating device capable of forming a coating film having an accurate stripe pattern with a desired line width and a desired thickness without fluctuation, when applying a coating material in a stripe pattern; (2) and a method for such coating.

These and other advantages of the present invention will become apparent to those skilled in the art upon reading and understanding the following detailed description with reference to the accompanying figures.

BRIEF DESCRIPTION OF THE DRAWINGS

FIG. 3A shows one of side blocks; FIG. 3B shows a back block; FIG. 3C shows a front block; and FIG. 3D shows another side block.

DESCRIPTION OF THE PREFERRED EMBODIMENTS

EXAMPLE 1

Hereinafter, Example 1 of the present invention will be described with reference to FIGS. 1 to 8.

Figure 1:
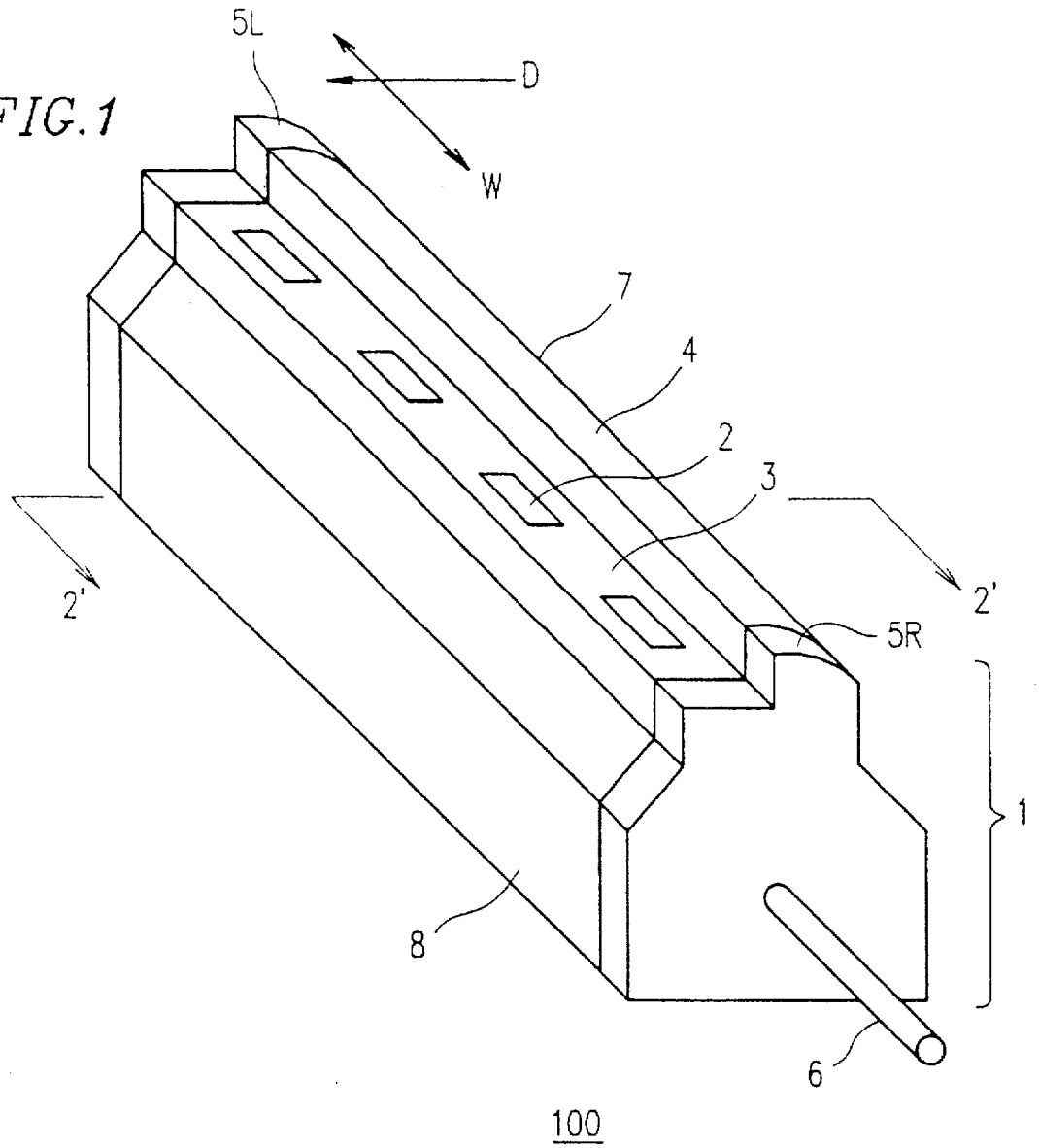
FIG. 1 is a perspective view of a coating device according to Example 1 of the present invention.
Figure 2:
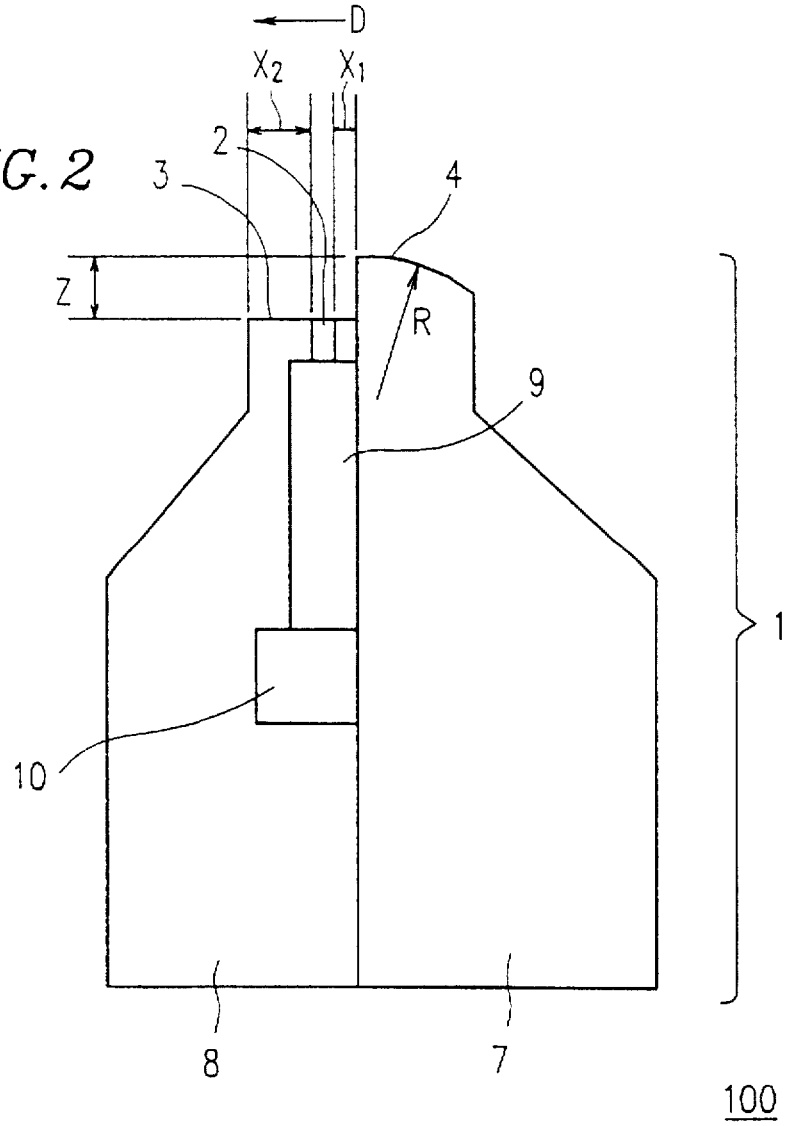
FIG. 2 is a cross-sectional view taken along line 2'—2' in FIG. 1.
Figure 3A:
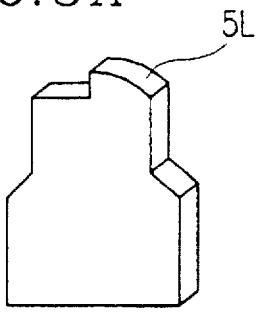
FIGS. 3A, 3B, 3C and 3D are perspective views showing each block included in a nozzle of the coating device shown in FIG. 1.
Figure 3B:
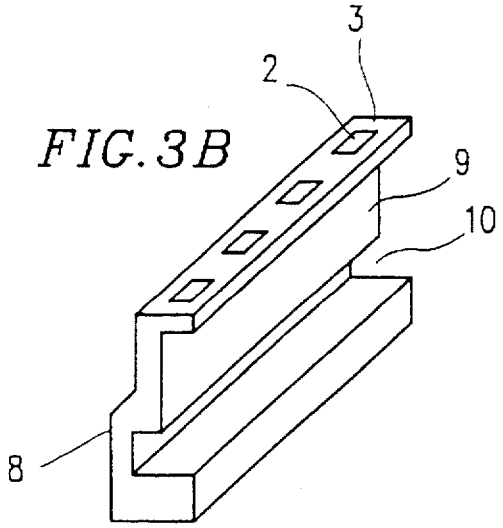
Figure 3C:
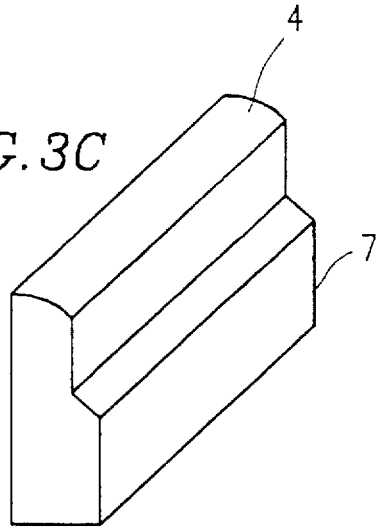
Figure 3D:
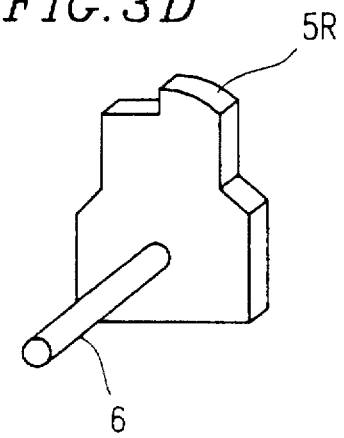

FIG. 1 is a perspective view of a coating device 100 according to Example 1 of the present invention. FIG. 2 is a cross-sectional view taken along line 2'—2' in FIG. 1. In FIGS. 1 and 2, a base material (not shown), on which a coating material is to be applied, travels in the direction of arrow D (hereinafter, this direction will be referred to as the "traveling direction" of the base material). The coating material is applied on a surface of the base material as the base material moves in the traveling direction.

The coating device 100 includes a nozzle 1 composed of a front block 7, a back block 8, and two side blocks 5R and 5L. FIGS. 3A to 3D are exploded perspective views respectively showing the configuration of each of the blocks 7, 8, 5R and 5L. The blocks 7, 8, 5R and 5L are connected to one another by means of screws (not shown). A pipe 6 for providing the coating material is connected with the side block 5R.

The top end of the front block 7 projects toward the traveling base material. The end face thereof is processed into a curved face 4 having a predetermined curvature (hereinafter, such a curved face is referred to as the "R face"). On the other hand, the top end of the back block 8 is processed into a flat face 3.

As shown in FIG. 2, the interior of the back block 8 is processed into such a shape as to constitute a manifold 10 when combined with the front block 7. Above the manifold 10, a continuous slit 9 extending along the width direction W of application is provided. A plurality of apertures 2, running through the flat face 3 from a top end of the slit 9, are provided at predetermined intervals. The apertures 2 function as discharging openings 2, through which the coating material is discharged. As shown in FIG. 1, the apertures 2 are provided on the flat face 3 at predetermined intervals, along the application width direction indicated by arrow W. Hereinafter, the term "aperture" and the term "discharging opening" are both used for referring to the same element denoted by the same reference numerals.

Figure 4:
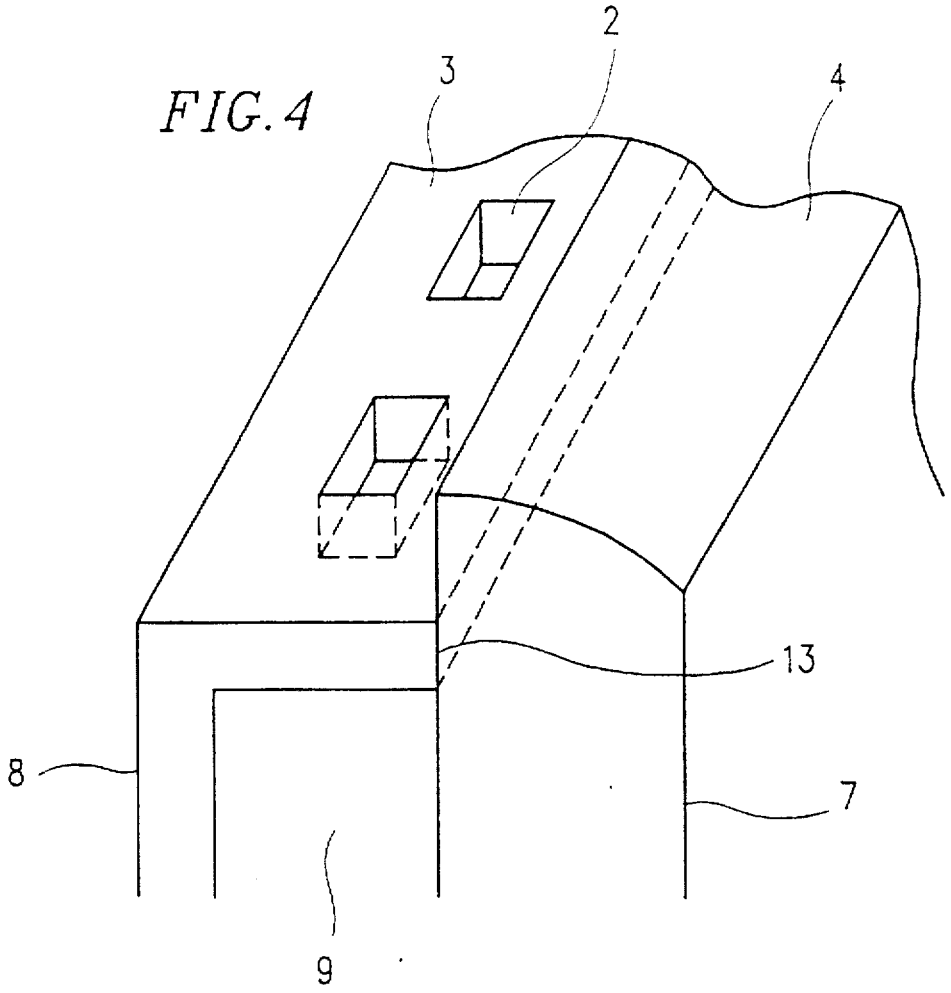
FIG. 4 is a magnified perspective view showing the vicinity of a tip portion of the nozzle of the coating device shown in FIG. 1.
Figure 5A:
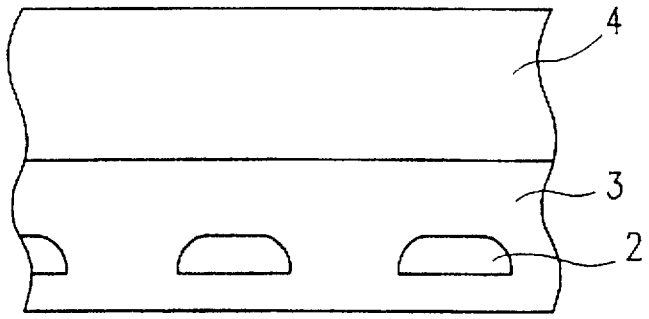
FIGS. 5A, 5B and 5C are views showing variant shapes of a discharging opening of the coating device of the present invention.
Figure 5B:
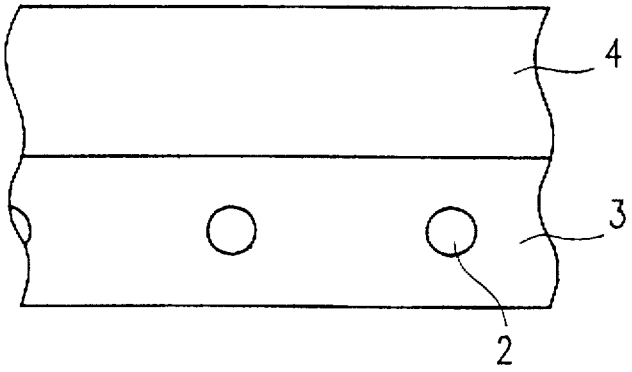
Figure 5C:
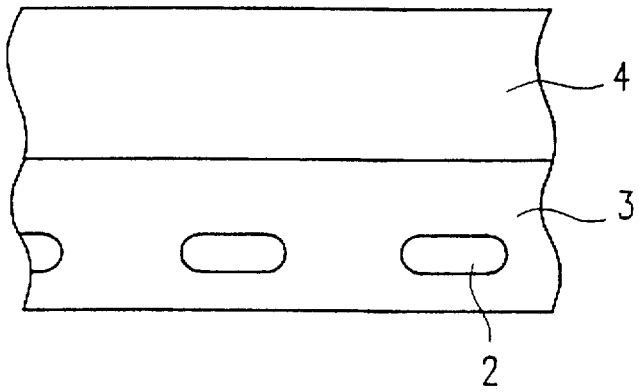

FIG. 4 is a magnified perspective view showing the vicinity of a tip end of the nozzle 1. The shape of each discharging opening 2, as seen from above the nozzle 1, need not be rectangular shapes such as those shown in FIGS. 1 to 4. For example, the shape may be square. Alternatively, the shape of each discharging opening 2 may be a circle, an elongated circle, or an elongated semi-circle, as shown in FIGS. 5A to 5C. The present invention does not intend to provide any limitations as to the shape of the discharging openings 2.

Figure 6:
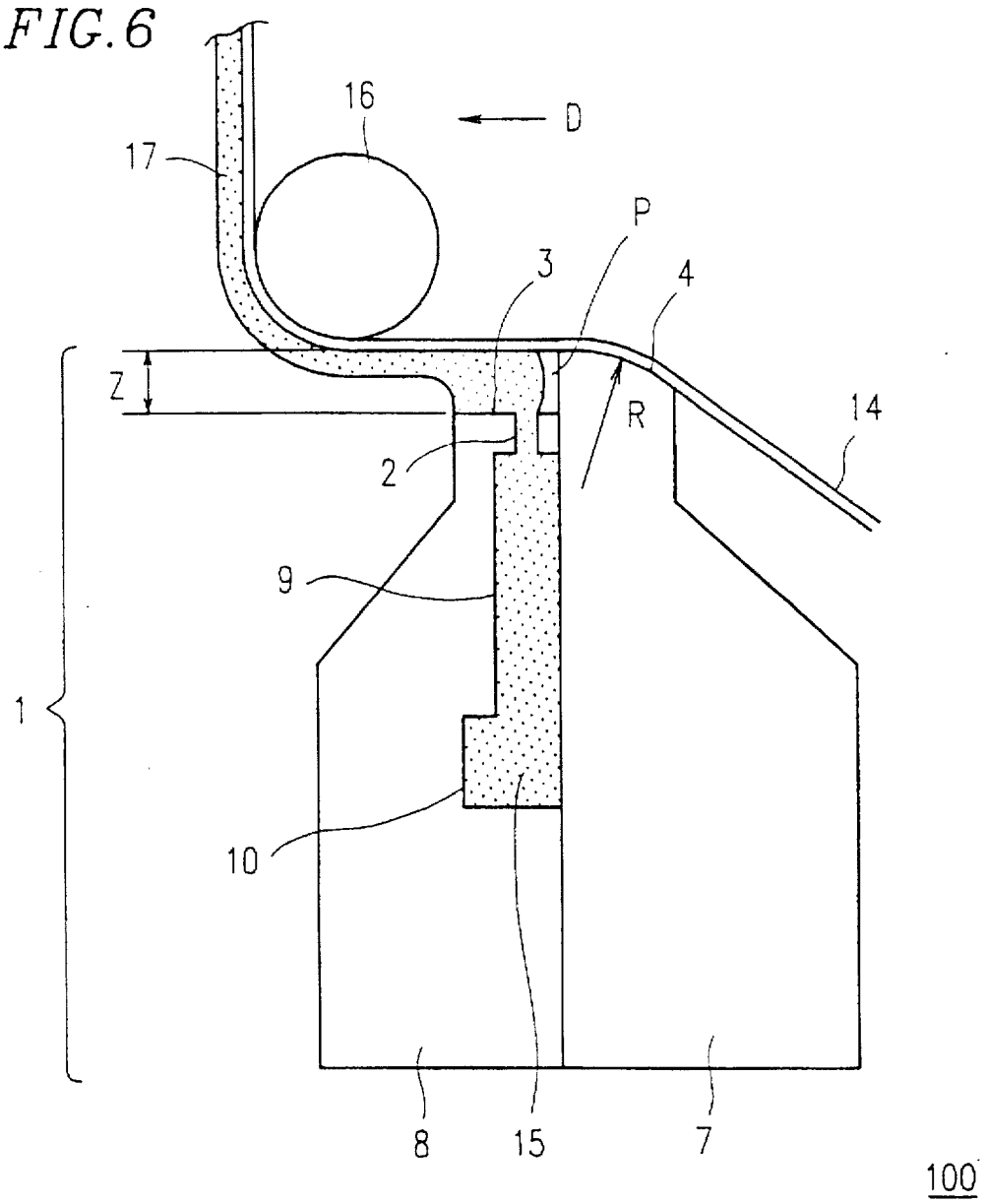
FIG. 6 is a cross-sectional view schematically showing the formation of a coating film by using the coating device shown in FIG. 1.

FIG. 6 is a cross-sectional view schematically showing the manner in which a coating material 15 is applied on a surface of a base material 14 to form a coating film 17 by the use of the coating device 100 having the above-described configuration.

Specifically, the coating material 15 is provided to the manifold 10 via the supply pipe 6 shown in FIG. 1 by way of a supply means (not shown) such as a constant pump. Thereafter, the coating material 15 is forced into the slit 9 from the manifold 10 owing to the pressure while being supplied, and is discharged through the apertures 2 so as to be applied onto the surface of the base material 14, which is traveling in the direction of arrow D. As a result, the coating film 17 is formed on the surface of the base material 14 in a predetermined stripe pattern.

The rate at which the base material 14 travels is typically in the range of 1 m/min to 100 m/min, and more preferably in the range of 5 m/min to 30 m/min. The supply rate of the coating material 15 is typically in the range of 0.1 cc/min to 10 cc/min, and more preferably in the range of 0.5 cc/min to 3 cc/min. However, these values may be optimized in accordance with the kind of coating material which is used, the physical characteristics of the coating material (e.g., viscosity and solid content), the thickness of the coating film to be formed, and the like.

The coating device 100 of the present invention, configurated as described above, provides the following advantages.

First, the line width of each stripe-shaped coating film 17 to be formed can be made equal to the dimension of each discharging opening 2 along the width direction W (hereinafter referred to as the "width dimension").

In accordance with the coating device 100, as shown in FIG. 6, the base material 14 first travels along the R face 4 at the top end of the front block 7, and thereafter passes above the flat face 3 of the back block 8 while being supported by a roll 16. The roll 16 may be a rotating roll, but it not limited thereto; it may be a fixed bar.

By optimizing the position of the roll 16 relative to the nozzle 1, the base material 14 can be ensured to travel substantially in parallel with the flat face 3. As a result, the coating material 15 discharged from the apertures 2 does not receive any plane pressure from the base material 14. Thus, the coating material 15 is prevented from spreading across along the application width direction W. This ensures that the line width of each stripe of the coating film 17 is equal to the width dimension of the aperture 2, whereby a stripe pattern having desired line widths can be securely obtained.

The base material 14 need not be strictly in parallel with the flat face 3, as long as the angle of the base material 14 with respect to the flat face 3 is within the range of ±10°.

In order to prevent the coating material 15 from receiving pressure at an interspace between the base material 14 and the flat face 3, it is preferable to prescribe a distance Z (shown in FIGS. 2 and 6) between the base material 14 and the flat face 3 to be 1 μm or larger. When the distance Z is smaller than 1 μm, the base material 14 is located substantially on the same plane as the flat face 3. As a result, plane pressure from the base material 14 is applied onto the coating material 15 discharged through the apertures 2, thus increasing the line widths of the stripes of the resultant coating film 17 to be larger than the width dimensions of the apertures 2.

On the other hand, it is preferable to prescribe the value of Z to be 200 μm or smaller in order to ensure that the coating material 15 is securely applied and attached onto the base material 14.

The actual value of Z can be optimized in accordance with the physical characteristics of the coating material 15 (e.g., viscosity and solid content), the thickness of the coating film 17 to be formed, and the like. The value of Z is preferably prescribed to be about twice as large as the thickness of the coating film 17 in a wet state. For example, in the case where the final thickness of the coating film 17 is to be 2 μm in a dry state, Z is typically prescribed at about 20 μm.

Next, the coating device 100 provides a second advantage in that the line widths of the stripes of the coating film 17 and the thickness of the coating film 17 can both be made uniform.

As shown in FIG. 6, the base material 14 first travels along the R face 4 at the top end of the front block 7. As a result, any wrinkles or creases of the base material 14 running along the width direction thereof are stretched out, so that the base material 14 becomes very flat when travelling above the discharging openings 2.

If wrinkles or creases are present on the surface of the base material 14 when the discharged coating material 15 attaches onto the surface of the base material 14, the width or thickness of the resultant coating film 17 may fluctuate. In contrast, in accordance with the coating device 100 of the present invention, the coating material 15 is applied onto the surface of the base material 14 without any wrinkles or creases existing thereon, so that the coating film 17 is formed into stripes maintaining the same width dimensions as when discharged through the apertures 2. As a result, the stripes do not fluctuate in line width, and the thickness thereof becomes uniform.

In order to enhance the above-mentioned advantage, it is important to prescribe the curvature radius R of the R face 4 an appropriate value. Preferably, the curvature radius R is prescribed to be within the range of 3 mm to 300 mm.

Since the base material 14 is ensured to travel along the R face 4, the base material 14 may be pressed against the R face 4 owing to tension if the curvature radius R of the R face 4 is smaller than 3 mm. This would result in a excessive plane pressure being applied to the base material 14 from the R face 4, thus preventing the base material 14 from smoothly sliding upon the R face 4 due to friction resistance. This causes the rate at which the base material 14 travels to fluctuate, thus making it difficult to achieve stable application of the coating material 15.

On the other hand, if the curvature radius R is larger than 300 mm, it becomes difficult to obtain adequate plane pressure for supporting the base material 14 at the R face 4. As a result, the stretching of wrinkles or creases present on the base material 14 along the width direction is not achieved, thereby undermining the above-mentioned advantages.

The effect of stretching wrinkles or creases present on the base material 14 by means of the R face 4 can be obtained irrespective of the thickness or the material of the base material 14. This effect is particularly outstanding in the case where a base material is composed of a material having a thickness as small as 10 (or slightly more) μm and therefore is susceptible to obvious wrinkles and creases, e.g., a polyester based film.

It is critical to both the aforementioned first and second advantages of the present invention to provide the discharging openings 2 on the flat face 3 of the back block 8. Furthermore, the present inventor has found that the positioning of the discharging openings 2 on the flat face 3 is particularly important in order to form the coating film 17 with line widths that are uniform in the order of micrometers.

Specifically, it is preferable to prescribe distances X1 and X2 shown in FIG. 2 to be within the predetermined ranges, respectively, as described below.

First, it is preferable to prescribe the distance X1 from the end face of the front block 7 to the brim of each discharging opening 2 to be within the range of 0.005 mm to 10 mm.

By ensuring that X1 is equal to or greater than 0.005 mm, a space P is created between the coating material 15 discharged through the apertures 2 and a side face of the front block 7, as shown in FIG. 6. As a result, the coating material 15 is prevented from attaching on the side face of the front block 7, thereby making it possible to ensure that the width dimension of each aperture 2 is equal to the line width of each stripe of the resultant coating film 17.

When X1 is smaller than 0.005 mm, the space P is not formed, so that the coating material 15 attaches onto the front block 7. As a result, the coating material 15 smudges on the side face of the front block 7, thereby making it difficult to form the coating film 17 so as to have predetermined line widths.

On the other hand, when X1 is 10 mm or less, the base material 14 is allowed to pass over the discharging opening 2 while being flat, after having its wrinkles or creases of the base material 14 stretched at the R face 4. As a result, the line widths of the stripes of the resultant coating film 17 can be made uniform.

When X1 is larger than 10 mm, wrinkles or creases may emerge again on the surface of the base material 14 before the base material 14 arrives at positions corresponding to the apertures 2, thereby reducing the abovementioned advantages.

The distance X2 between the end face of the back block 8 to the brim of each discharging opening 2 is preferably within the range of 0.1 mm to 10 mm.

By prescribing X2 to be 10 mm or less, it becomes possible to make uniform the hydrodynamic resistance of the coating material 15 flowing through the interspace between the base material 14 and the flat face 3 with respect to all the stripes of the resultant coating film 17. Thus, the line widths of the stripes of the resultant coating film 17 can be made uniform.

When X2 is larger than 10 mm, the hydrodynamic resistance fluctuates, thereby allowing the line widths of the stripes to fluctuate.

With respect to the lower limit of X2, it is preferably set to be 0.1 mm or more. A value of X2 which is less than 0.1 mm provides for a sharp edge, resulting in the situation in which the coating material, which is discharged from the apertures 2 and attached on the base material 14, is stripped off.

In making uniform the line widths and thickness of the stripes of the coating film 17, the configuration of the coating device 100, in which the nozzle 1 is composed of a combination of the blocks 7, 8, 5R, and 5L, has the following advantages.

Unlike in the case where a nozzle is formed from one bulk material, the manifold 10 and slit 9 in the coating device 100, which function as passages for the coating material 15 to be applied, can be accurately processed by plane grinding of surfaces of the back block 8. In particular, the planarity of the inner face of the slit 9 can be improved on the order of several micrometers. As the planarity of the slit 9 increases, the accuracy and constancy of the width of the slit 9 increase.

When the width of the slit 9 is constant, the internal pressure of the coating material 15 becomes constant along the width direction W when the coating material 15 which is forced into the slit 9 from the manifold 10 moves inside the slit 9. This uniformity of pressure is referred to as a flow adjustment. As a result of the flow adjustment, the amount of the coating material 15 discharged through the apertures 2 becomes uniform, thereby making the line widths and thicknesses of the stripes of the resultant coating film 17 uniform.

In order to achieve uniformity of pressure based on the flow adjustment, it is preferable to prescribe the length of the slit 9, i.e., the distance between the manifold 10 and each discharging opening 2, to be within the range of 10 mm to 100 mm. The actual length of the slit 9 is to be optimized in accordance with the kind of coating material 15 which is used, the pressure at which the coating material 15 is supplied, the amount of the coating material 15 supplied, and the like.

When processing the blocks 7, 8, 5R and 5L, an abutting face 13 (shown in FIG. 4) between the back block 8 and the front block 7 must be made planar in order to prevent the coating material 15 from leaking out from the slit 9.

Figure 7:
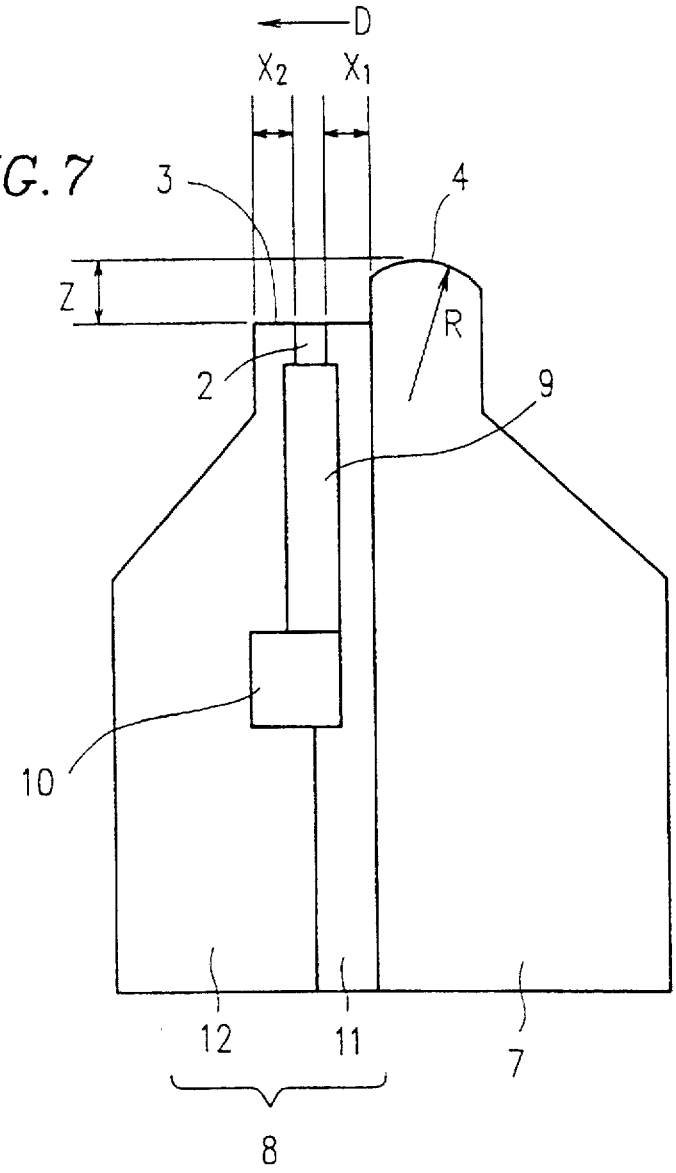
FIG. 7 is a cross-sectional view showing a variant of the nozzle of the coating device shown in FIG. 1.

In the present example, the back block 8 is described as one member. However, the same advantages of the present example described above can be obtained by composing the back block 8 with a first back block 11 and a second back block 12, as shown in FIG. 7. In this case, the manifold 10 and the slit 9 may be formed in an abutting face between the first back block 11 and the second back block 12. In FIG. 7, component elements which also appear in FIG. 1 are indicated by the same reference numerals as those used therein, and the description thereof are omitted.

The material of the blocks 7, 8, 5R and 5L is typically stainless steel. Alternatively it is also possible to use die steel, high-speed steel, hard metal, or the like. The coating material 15 to be applied and the material of the base material 14 are not limited to those mentioned above.

Figure 8:
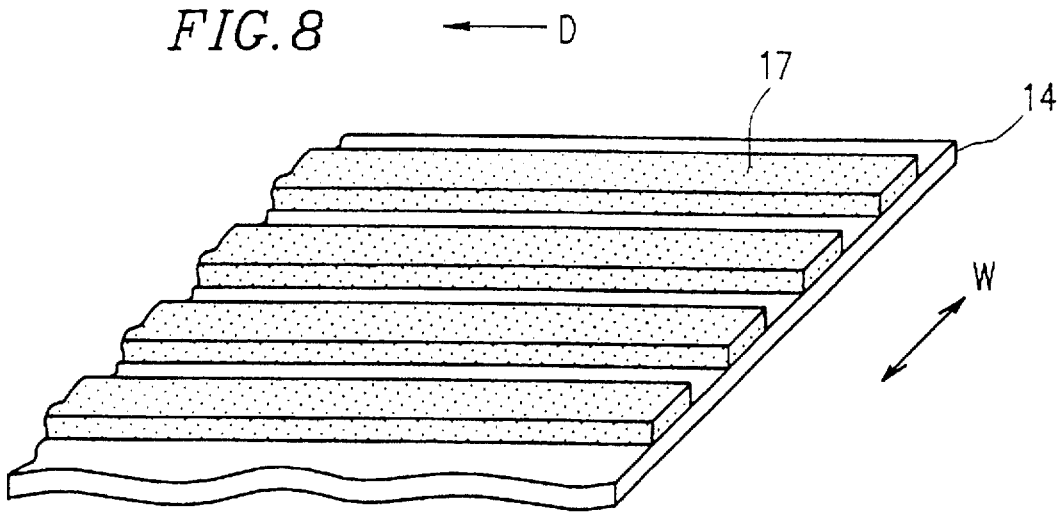
FIG. 8 is a schematic view showing a stripe-shaped coating film formed by using the coating device shown in FIG. 1.

FIG. 8 schematically shows an exemplary stripe pattern of the coating film 17 formed on the base material 14 by using the coating device 100. Specifically, the coating film 17 is formed on the surface of the base material 14, traveling in the direction of arrow D, in stripes arranged along the direction indicated by arrow W.

The coating device 100 used herein is such that the curvature radius R of the R face 4 of the front block 7, the distance X1 and the distance X2 shown in FIG. 2, are 30 mm, 1 mm, and 2 mm, respectively. 500 apertures 2 each having a rectangular shape (as seen from above) are formed. Each aperture 2 has a width dimension of 200 μm, and a dimension of 150 μm along the direction in which the base material 14 travels (hereinafter, the latter dimension will be referred to as the "travelling direction dimension"). The base material 14 is a polyethylene telephthalate film having a thickness of 15 μm and a width of 10 mm.

The stripes of the resultant coating film 17 shown in FIG. 8 have an average line width of 200 μm, the fluctuation thereof being within the range of ±2 μm. The stripes have an average thickness of 1 μm, the fluctuation thereof being within the range of ±0.02 μm.

Thus, by using the coating device 100, it is possible to form excellent stripe-shaped coating films having very uniform line widths and thicknesses.

EXAMPLE 2

Hereinafter, a coating device 200 according to Example 2 of the present invention will be described with reference to FIGS. 9 to 12.

Figure 9:
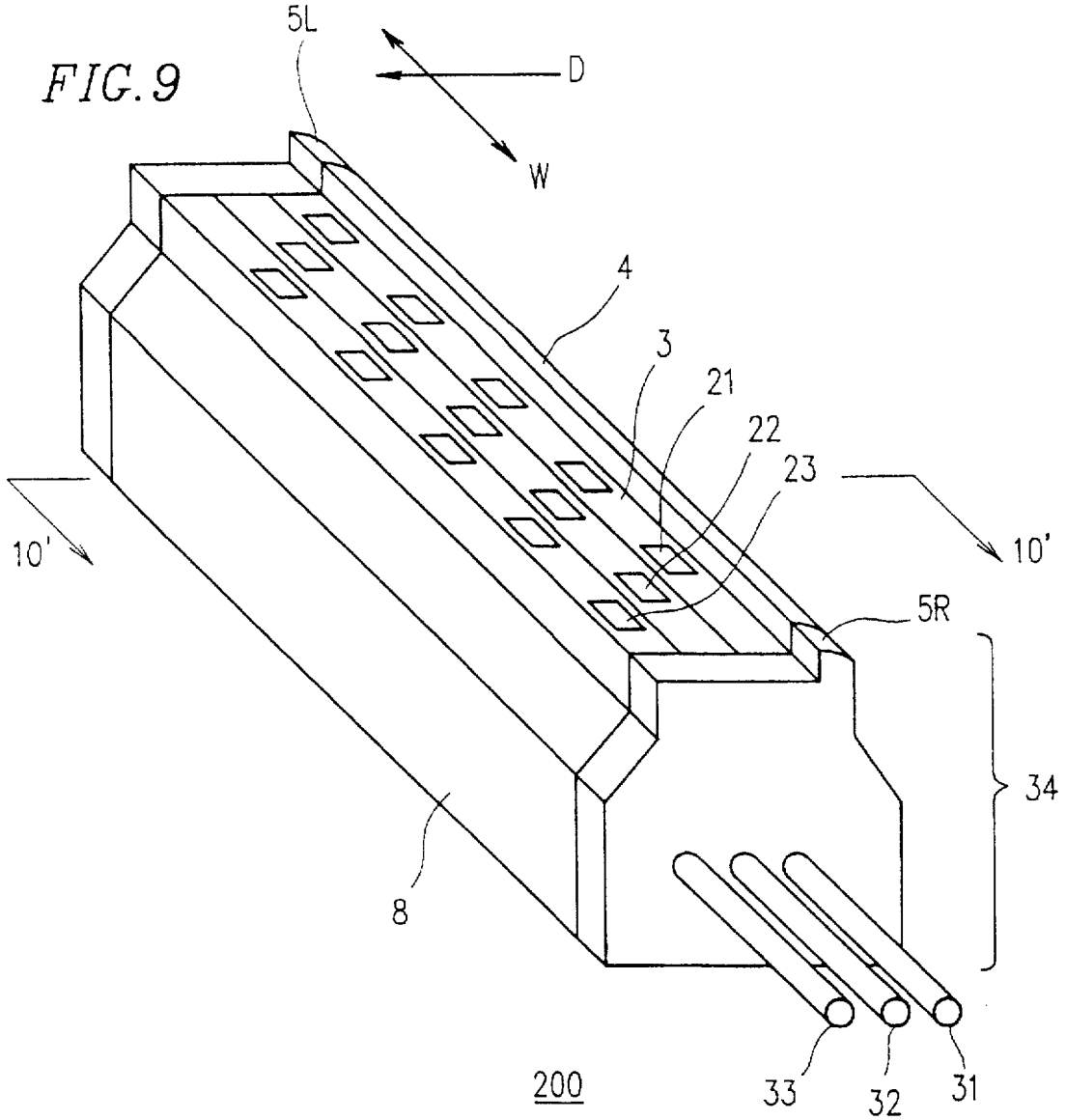
FIG. 9 is a perspective view showing a coating device according to Example 2 of the present invention.
Figure 10:
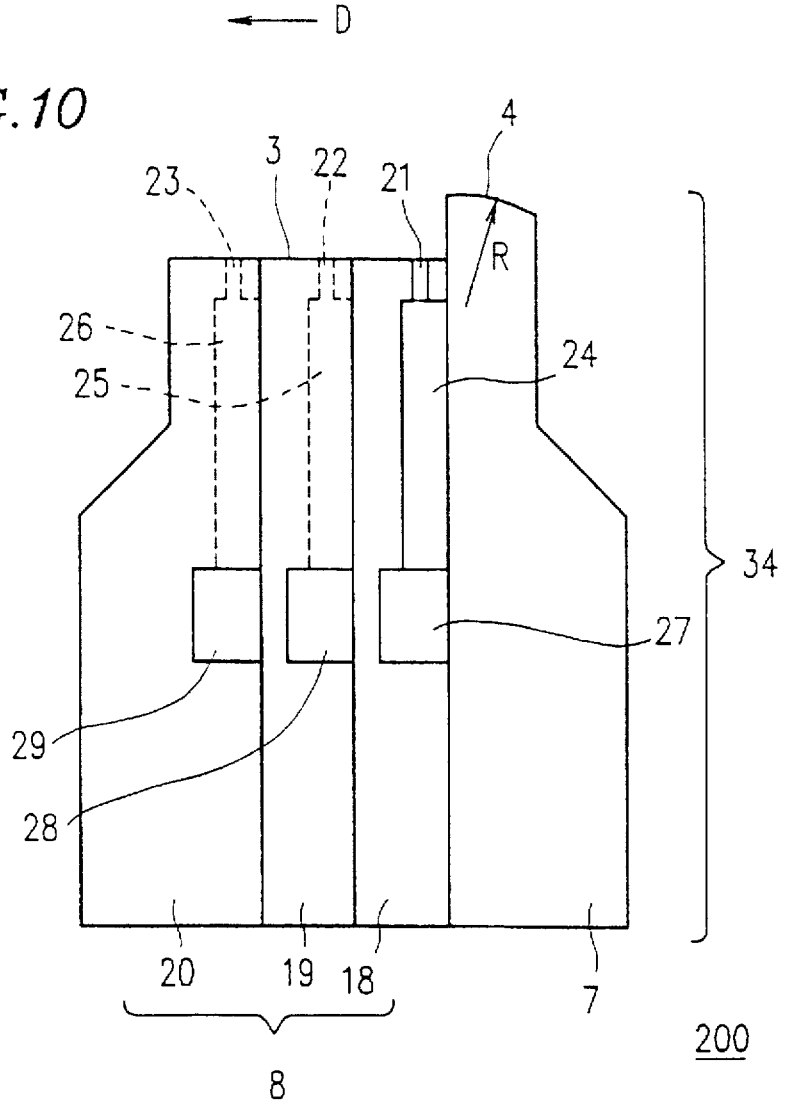
FIG. 10 is a cross-sectional view taken along line 10'—10' in FIG. 9.
Figure 11:
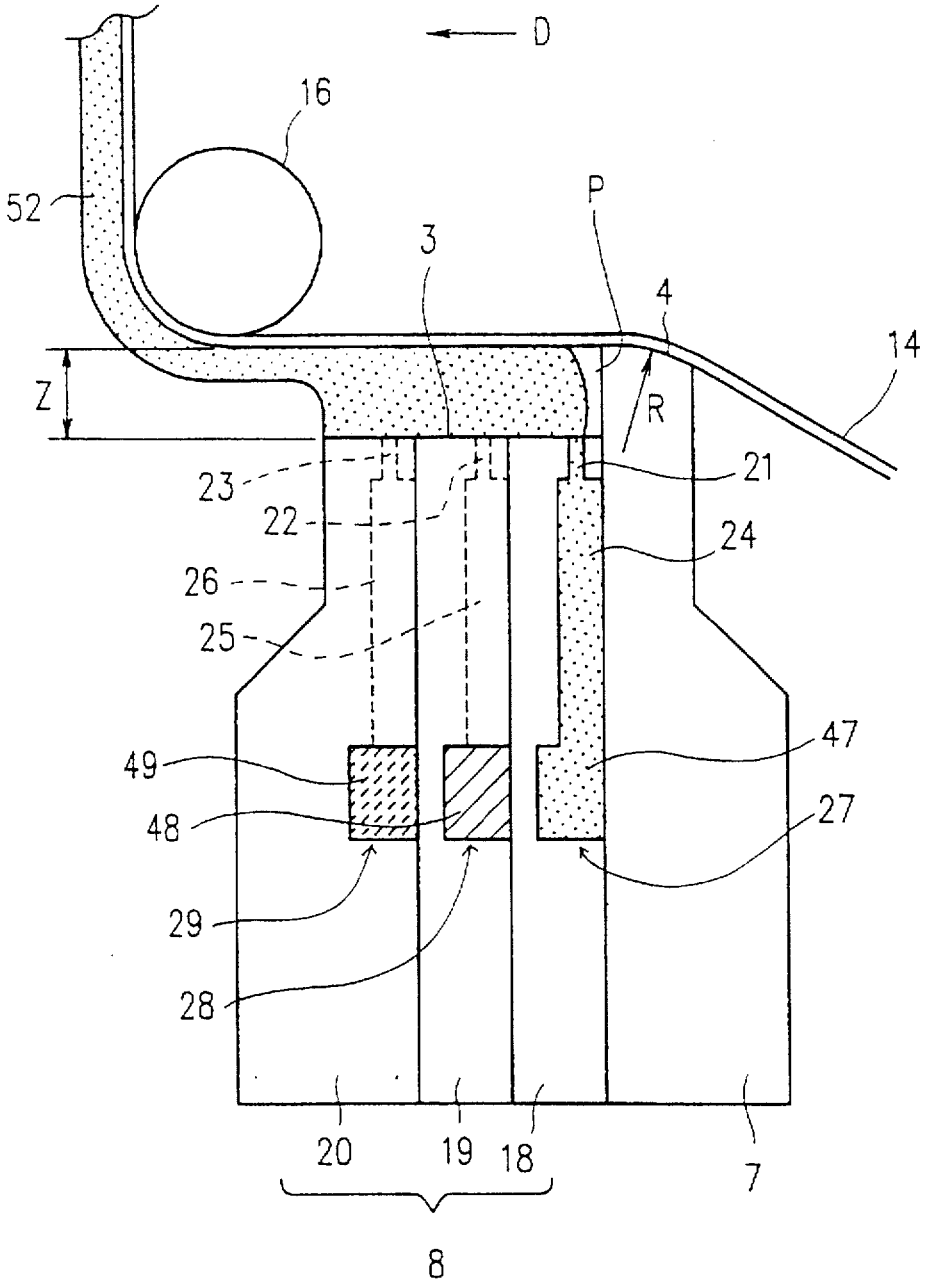
FIG. 11 is a schematic cross-sectional view showing the formation of a coating film by using the coating device shown in FIG. 9.

FIG. 9 is a perspective view of the coating device 200. FIG. 10 is a cross-sectional view taken along line 10'—10' in FIG. 9. FIG. 11 is a schematic cross-sectional view showing the manner in that a coating material is applied on a surface of a base material 14 by using the coating device 200. Those component elements of the coating device 200 which also appear in the coating device 100 are indicated by the same references, and the description thereof are omitted.

The coating device 200 differs from the coating device 100 of Example 1 in the configuration of a back block 8 included in a nozzle 34. Specifically, the back block 8 is composed of a combination of a first back block 18, a second back block 19, and a third back block 20.

As shown in FIG. 10, the first back block 18 includes a first manifold 27, a first slit 24, and a first discharging opening 21. Similarly, the second back block 19 includes a second manifold 28, a second slit 25, and a second discharging opening 22, and the third back block 20 includes a third manifold 29, a third slit 26, and a third discharging opening 23. The processing of the first to third back blocks 18 to 20 can be conducted in the same manner as in the case of the back block 8 of the coating device 100.

The top faces of the first to third back blocks 18 to 20 are on the same plane so as to constitute the flat face 3. The flat face 3 functions in the same manner as does the flat face 3 of the back block 8 of the coating device 100.

The first to third discharging openings 21 to 23 are arranged on the flat face 3 in three rows along a direction D in which the base material 14 travels. In their respective rows, the discharging openings 21 to 23 are arranged at an equal pitch along the application width direction W. The first apertures 21 in the first row, the second apertures 22 in the second row, and the third apertures 23 in the third row discharge respectively different coating materials, so as to form different stripe-shaped coating films. The apertures 21 to 23 are arranged in such a manner that the respective resultant stripe-shaped coating films do not overlap with one another. As a result, it is possible to simultaneously apply three different coating materials on the surface of the base material 14 in accurate stripes not overlapping with one another.

In accordance with the coating device 200, as shown in FIG. 11, a first coating material 47 is provided to the first manifold 27 via a first supply pipe 31 by way of a supply means (not shown) such as a constant pump. Thereafter, the first coating material 47 is forced into the first slit 24 from the first manifold 27 owing to the pressure while being supplied, and is discharged through the first apertures 21 so as to be applied onto the surface of the traveling base material 14. As a result, a first coating film 52 is formed on the surface of the base material 14 in a predetermined stripe pattern.

Similarly, a second coating material 48 is provided to the second manifold 28 via a second supply pipe 32 by way of a supply means (not shown) such as a constant pump. Thereafter, the second coating material 48 is applied onto the surface of the base material 14 via the second slit 25 and the second apertures 22. As a result, a second coating film 53 is formed on the surface of the base material 14 in a predetermined stripe pattern.

Similarly, a third coating material 49 is provided to the third manifold 29 via a third supply pipe 33 by way of a supply means (not shown) such as a constant pump. Thereafter, the third coating material 49 is applied onto the surface of the base material 14 via the third slit 26 and the third apertures 23. As a result, a third coating film 54 is formed on the surface of the base material 14 in a predetermined stripe pattern.

Thus, in accordance with the coating device 200, the different kinds of coating materials 47 to 49 are discharged via the first to third discharging openings 21 to 23, respectively, so that the first to third coating films 52 to 54 are formed side by side on the base material 14.

Figure 12:
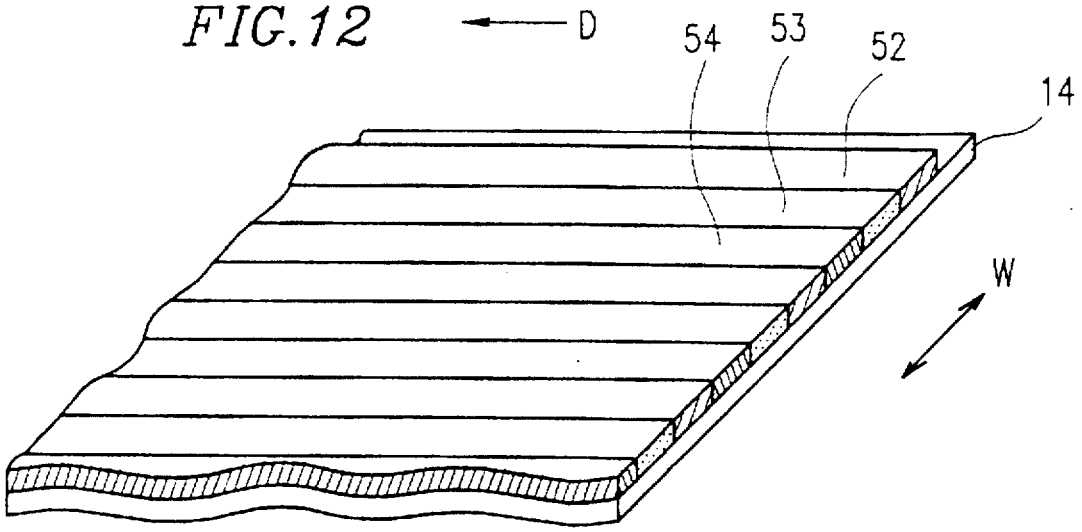
FIG. 12 is a schematic view showing stripe-shaped coating films formed by using the coating device shown in FIG. 9.

FIG. 12 is a schematic view showing examples of the first to third coating films 52 to 54 formed on the base material 14 by using the coating device 200. Specifically, the stripe-shaped first to third coating films 52 to 54 are formed on the surface of the base material 14 traveling in the direction of arrow D, the first to third coating films 52 to 54 being disposed sequentially in the direction of arrow W.

The coating device 200 used herein includes 500 each of first apertures 21, second apertures 22, and third apertures 23, each having a rectangular shape (as seen from above). Each aperture 21, 22 or 23 has a width dimension of 100 μm and a travelling direction dimension of 75 μm. The first to third apertures 21 to 23 are all arranged at a pitch of 300 μm along the application width direction W. The base material 14 is a polyethylene telephthalate film having a thickness of 15 μm and a width of 180 mm. The first to third coating materials 47 to 49 are obtained by dispersing red, blue, and green pigments, respectively, into a resin and a solvent.

The stripes of the resultant first to third coating films 52 to 54 shown in FIG. 12 have an average line width of 100 μm, the fluctuation thereof being within the range of ±2 μm. The stripes have an average thickness of 1 μm, the fluctuation thereof being within the range of ±0.02 μm. The first to third coating films 52 to 54 do not overlap with one another along the width direction W.

Thus, by using the coating device 200, it is possible to form coating films of different coating materials in accurate stripe patterns which do not overlap with one another along the width direction, the stripes having very uniform line widths and thicknesses.

By applying the present example to the production of a color filter of red, blue, and green, a color filter can be obtained such that the surface thereof is flat and that the adjoining color portions closely contact with each other without overlapping.

In a printing method, which is a conventional method of producing a color filter, the printed films corresponding to respective pixels of red, blue, and green of the resultant color filter each have a convex cross section. As a result, the central portion and end portions of each pixel have a noticeable difference in color density. In contrast, a color filter produced according to the present example is such that the coating films, which correspond to the respective pixels, are formed with uniform thicknesses, so that the central portion and end portions of each pixel have very little difference in color density. As a result, the product performance of the color filter remarkably improves.

A conventional color filter requires a post-production process, e.g., flattening the surface thereof, in order to eliminate the above-mentioned problem due to the convex cross sections of the resultant coating films. The color filter in accordance with the present example does not require such post-production processes. Furthermore, according to the present example, it is possible to simultaneously form stripes in three colors by using a single nozzle, unlike in the conventional technique. As a result, the facility cost can be reduced and the production process can be simplified. Thus, by applying the present example of the invention to the production of a color filter, the production cost of the color filter can be reduced.

In the above explanation, the coating device 200 is described to be capable of applying three different kinds of coating materials. However, the present example is not limited to that number of coating materials. It would be easy for one skilled in the art to modify the coating device 200 so as to be capable of applying two different kinds of coating materials or, alternatively, four or more kinds of coating materials on a base material in order to form stripe patterns of the respective coating films.

The coating device 200 in this example can provide the similar advantages as in the coating device 100 in Example 1 by respectively prescribing values of Z, X1, X2 and R in the aforementioned respective preferable ranges.

EXAMPLE 3

Hereinafter, a coating device 300 according to Example 3 of the present invention will be described with reference to FIGS. 13 to 16.

Figure 13:
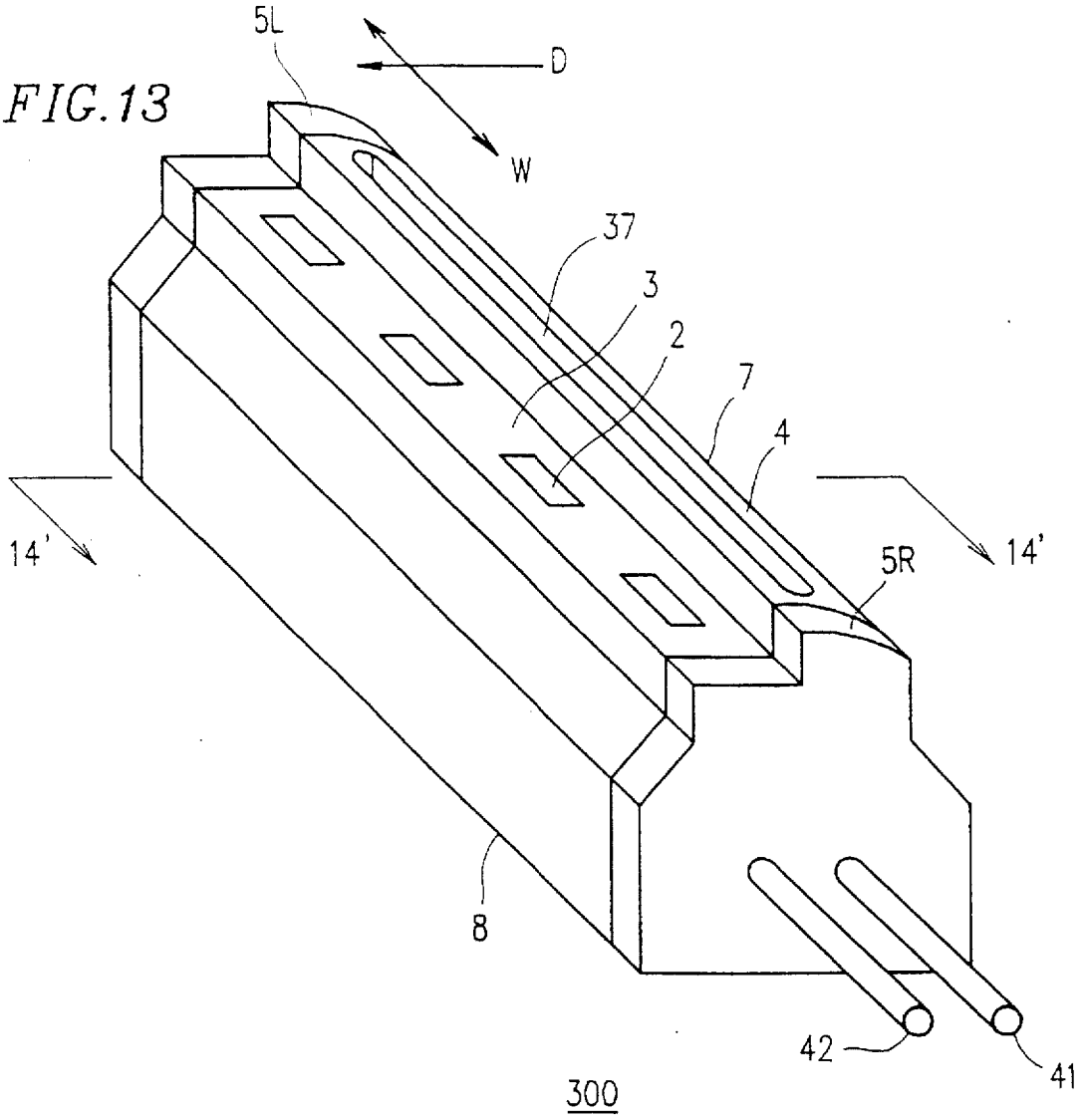
FIG. 13 is a perspective view showing the coating device according to Example 3 of the present invention.
Figure 14:
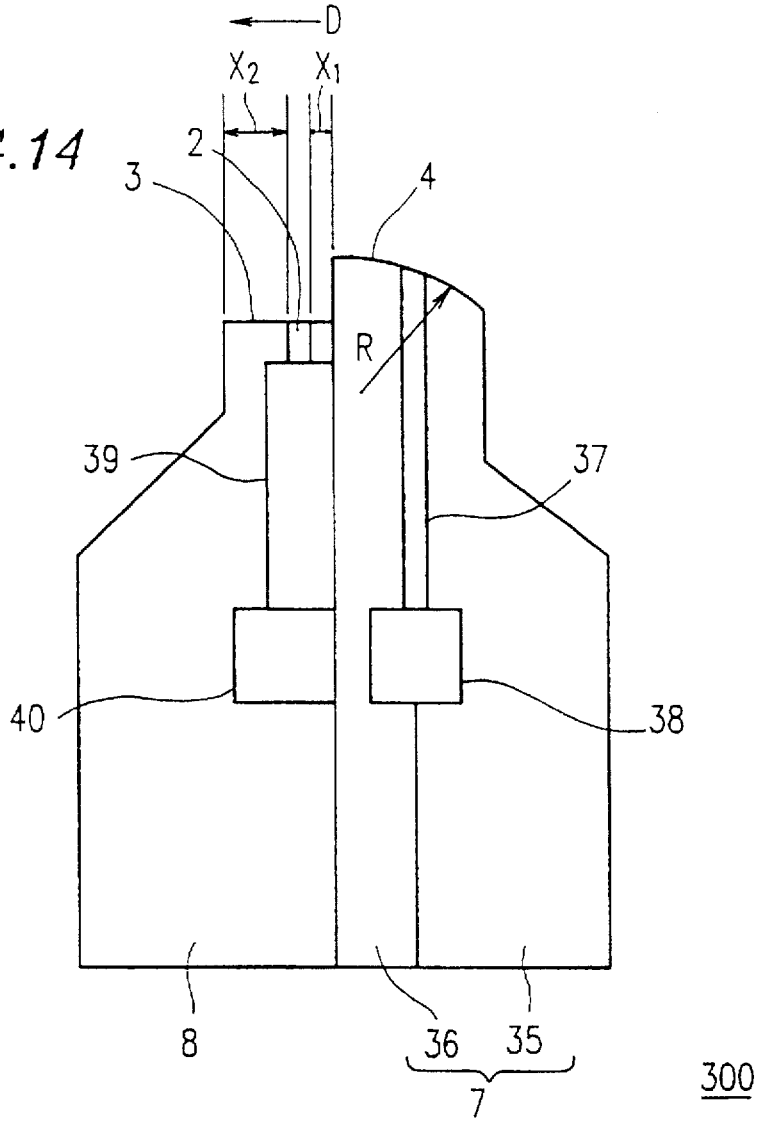
FIG. 14 is a cross-sectional view taken along line 14'—14' in FIG. 13.
Figure 15:
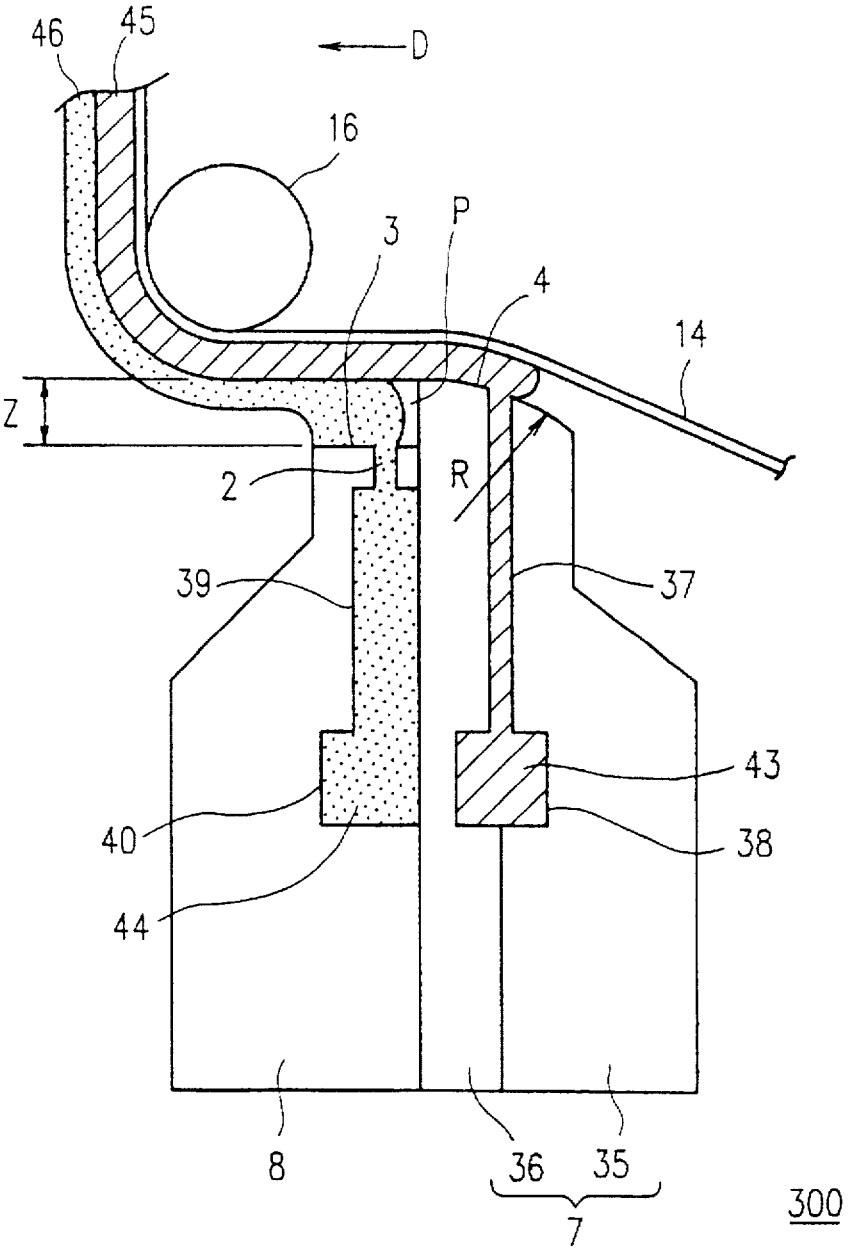
FIG. 15 is a schematic cross-sectional view showing the formation of coating films by using the coating device shown in FIG. 13.

FIG. 13 is a perspective view of the coating device 300. FIG. 14 is a cross-sectional view taken along line 14'—14' in FIG. 13. FIG. 15 is a schematic cross-sectional view showing the manner in which coating materials are applied on a surface of a base material 14 by using the coating device 300. Those component elements of the coating device 300 which also appear in the coating device 100 are indicated by the same references, and the description thereof are omitted.

The coating device 300 differs from the coating device 100 of Example 1 in the configuration of the front block 7.

Specifically, the front block 7 is composed of a combination of a first front block 35 and a second back block 36, as shown in FIG. 14. An abutting face of the first front block 35 and an abutting face of the second front block 36 are processed into such a shape as to form a first manifold 38 and a first slit 37 when combined.

The first slit 37 extends from the top end of the first manifold 38 to the R face 4 at the top end of the front block 7, so as to open on the R face 4. As shown in FIG. 13, the first slit 37 is made continuous along the application width direction W, so that the opening on the R face 4 is also continuous along the application width direction W. Furthermore, a first pipe 41 for supplying a first coating material 43 from the outside is connected to the first manifold 38.

In the interior of a back block 8, a manifold 40, a slit 39 and discharging openings 2 are provided, as in the case of the coating device 100 of Example 1. The configurations and the production methods for the manifold 40, the slit 39 and the discharging openings 2 are the same as in the case of the coating device 100, so that the descriptions thereof are omitted. However, in the present example, the manifold 40 and the slit 39 will conveniently be referred to as the second manifold 40 and the second slit 39 in order to be distinguish from the first manifold 38 and the first slit 37 of the front block 7. A second pipe 42 for supplying a second coating material 44 from the outside is connected to the second manifold 40.

By using the coating device 300, it becomes possible to apply different kinds of coating materials on a surface of the base material 14 in a multilayered structure.

In accordance with the coating device 300, as shown in FIG. 15, the first coating material 43 is provided to the first manifold 38 via the first supply pipe 41 by way of a supply means (not shown) such as a constant pump. Thereafter, the first coating material 43 is thrust into the first slit 37 from the first manifold 38 owing to the pressure while being supplied, and is discharged so as to be applied onto the surface of the traveling base material 14. As a result, a first coating film 45 is formed on the surface of the base material 14 in a predetermined stripe pattern.

In the coating device 300, it is ensured that the base material 14 travels without directly contacting the R face 4 of the front block 7. The first coating material 43 is discharged through the first slit 37 uniformly along the application width direction W. As a result, the first coating film 45 is formed so as to have a uniform width and a uniform thickness along the application width direction W substantially over the entire surface of the base material 14.

In accordance with the coating device 300, it is ensured that the base material 14 travels above the R face 4 with a distance created by the first coating material 43 therebetween. When the base material 14 travels while sliding against the R face 4, the traveling rate of the base material 14 may fluctuate owing to friction resistance. However, the coating device 300 is free from such fluctuation in the traveling rate of the base material 14, so that it is possible to eliminate the fluctuation in the line width of the resultant coating film. Thus, the wrinkles or creases of the base material 14 along the application width can be eliminated since the movement of the base material 14 becomes smooth.

After uniformly applying the first coating material 43 (which serves as a lower layer) on the surface of the base material 14 in the above-mentioned manner, the second coating material 44 is applied on the coating material 43 as an upper layer. The second coating material 44 is provided to the second manifold 40 via the second supply pipe 42 by way of a supply means (not shown) such as a constant pump. Thereafter, the second coating material 44 is thrust into the second slit 39 from the second manifold 40 owing to the pressure while being supplied, and is discharged via the apertures 2 so as to be applied onto the surface of the first coating film 45. As a result, a stripe pattern, including the second coating film 46 formed on the first coating film 45, is formed on the surface of the base material 14.

By applying the present example to the production of a multilayered ceramic chip capacitor (hereinafter referred to as a "chip capacitor"), the production process thereof can be simplified. As a result, the production cost of the chip capacitor can be greatly reduced. At the same time, the capacitance of the resultant chip capacitor can be greatly improved.

In a conventional method for producing a chip capacitor, a dielectric layer of barium titanate or the like is first formed on a base material, on which a predetermined pattern of conductive paste is printed as internal electrodes. Thereafter, the resultant multilayer structure of the dielectric layer and the conductive paste layer is peeled off the base material. A plurality of such multilayer structures are further laminated so as to form a chip capacitor.

On the other hand, by applying the present example to the production of a chip capacitor, it becomes possible to apply a dielectric layer and a conductive paste layer on a base material sequentially but substantially simultaneously. As a result, what requires two steps by the conventional method can be performed in one step, thereby remarkably improving the productivity of the chip capacitor.

Moreover, the conventional method forms a predetermined pattern of a conductive paste layer as internal electrodes by printing, so that the fluctuation in the thickness of the internal electrodes can be as large as ±0.2 μm for a thickness of 1 μm. Owing to this, the upper limit of the number of layers to be laminated is at about 100. On the other hand, according to the present example, the fluctuation in the thickness of the internal electrodes can be reduced to about ±0.02 μm for a thickness of 1 μm. As a result, about 200 layers of the dielectric layer/conductive paste layer structures can be laminated without allowing lamination dislocation to occur.

Thus, in accordance with the present example, the number of multilayer structures to be laminated in a chip capacitor can be increased, so that a chip capacitor having a large capacitance can be produced.

Figure 16:
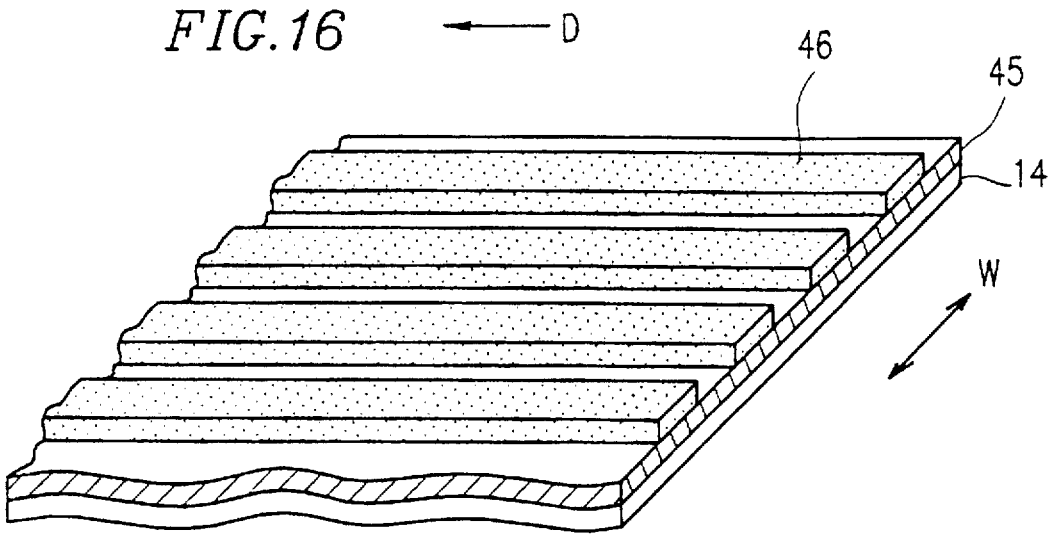
FIG. 16 is a schematic view showing a stripe-shaped coating film formed by using the coating device shown in FIG. 13.

FIG. 16 is a schematic view showing examples of the first and second coating films 45 and 46 formed on the base material 14 by using the coating device 300. Specifically, the first coating film 45 (which serves as a lower layer) is formed on the surface of the base material 14 traveling in the direction of arrow D, and the second coating film 46 is further formed on the first coating film 45 in stripes disposed in the direction of arrow W.

The coating device 300 used herein is such that the curvature radius R of the R face 4 of the front block 7, the distance X1 and the distance X2 shown in FIG. 2, are 30 mm, 1 mm and 2 mm, respectively, and 50 discharging openings 2 each having a rectangular shape (as seen from above) are formed. Each discharging opening 2 has a width dimension of 1 mm, and a travelling direction dimension of 200 μm. The base material 14 is a polyethylene telephthalate film having a thickness of 50 μm and a width of 120 mm. A ceramic slurry and a conductive paste are used as the first and second coating materials 43 and 44, respectively.

The stripes of the resultant second coating film 46 shown in FIG. 16 have an average line width of 1 mm, the fluctuation thereof being within the range of ±10 μm. The stripes have an average thickness of 1 μm, the fluctuation thereof being within the range of ±0.02 μm.

Thus, by using the coating device 300, it is possible to form the second coating film 46 as the upper layer in stripes having very uniform line widths and thicknesses on the first coating layer 45 serving as the lower layer.

By applying the present example to the production of chip capacitors, it becomes possible to form about 200 multilayer structures laminated onto one another. Thus, large-capacitance chip capacitors can be easily produced.

The coating device 300 in this example can provide similar advantages as in the coating device 100 in Example 1 by respectively prescribing values of Z, X1, X2 and R in the aforementioned respective preferable ranges. It should be noted that the distance Z in the coating device 300 is measured as a distance between the surface of the first coating film 45 and the flat face 3 of the back block 8, as shown in FIG. 15.

EXAMPLE 4

Hereinafter, a coating device 400 according to Example 4 of the present invention will be described with reference to FIGS. 17 to 18.

Figure 17:
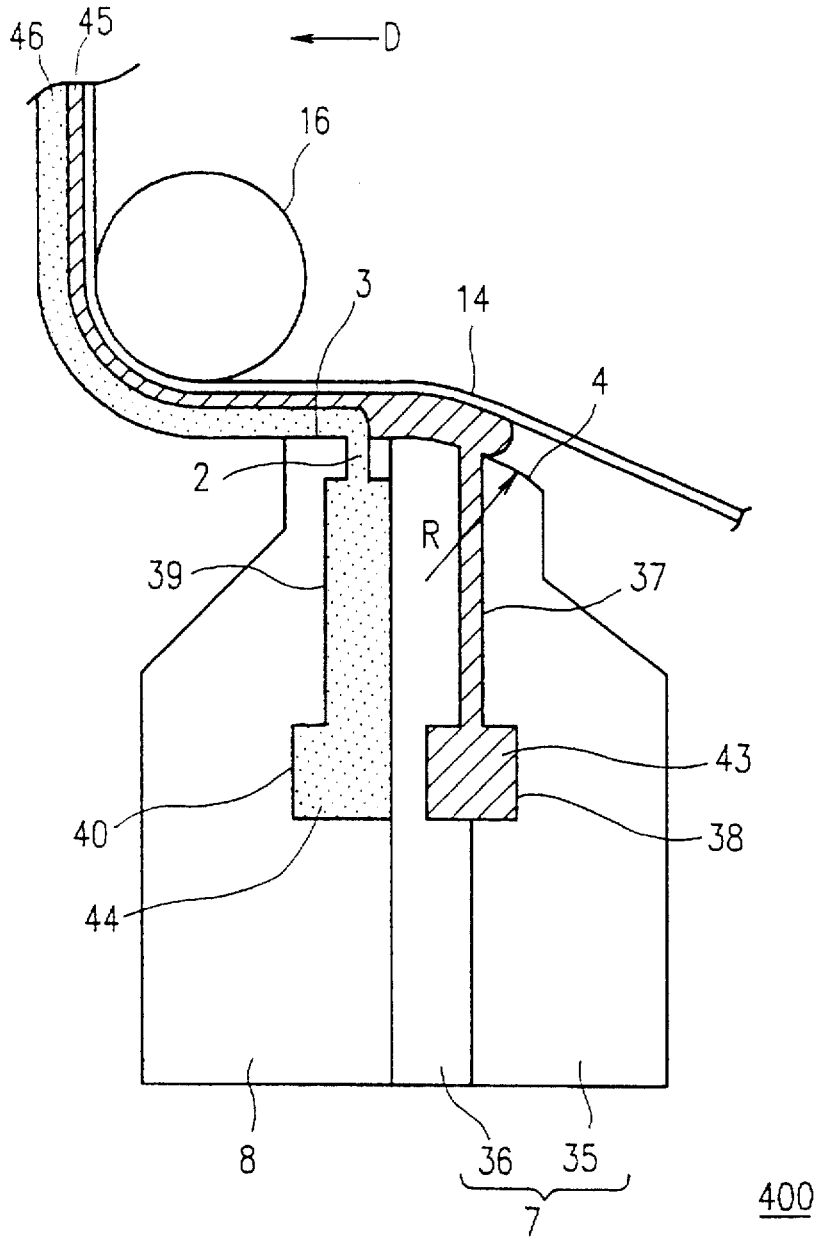
FIG. 17 is a perspective view showing a coating device according to Example 4 of the present invention and the formation of coating films by using the coating device.

FIG. 17 is a perspective view of the coating device 400. FIG. 18 is a schematic cross-sectional view showing the manner coating materials are applied on a surface of a base material 14 by using the coating device 400. Those component elements of the coating device 400 which also appear in the coating device 300 are indicated by the same references, and the description thereof are omitted.

Unlike the coating device 300, the coating device 400 has no difference in level between an end portion of an R face 4 at the top end of a front block 7 and a flat face 3 at the top end of a back block 8. As a result, it is possible to form a second coating film 46 so as to be buried in a first coating film 45 serving as a lower layer.

In order to form the second coating film 46 so as to have a predetermined width and thickness, it is necessary to prevent a second coating material 44 from spreading along the application width direction and ensure that the second coating material 44 is buried in the first coating film 45 to the predetermined depth. In order to achieve this, the plane pressure from the base material 14 and the first coating film 45 must not be applied to the second coating material 44 discharged from discharging openings 2. Therefore, as described earlier, it is very important to ensure that the base material 14 travels substantially in parallel to the flat face 3.

By applying the present example to the production of a chip capacitor, it becomes possible to largely increase the capacitance of the resultant chip capacitor. That is, according to the present example, the surface of a dielectric layer (i.e., the first coating film 45) and the surface of a stripe-shaped internal electrode layer (i.e., the second coating film 46) have no difference in level, so that the number of such multilayer structures to be laminated can be increased to about 300. Thus, capacitance of the resultant chip capacitor can be further increased.

Figure 18:
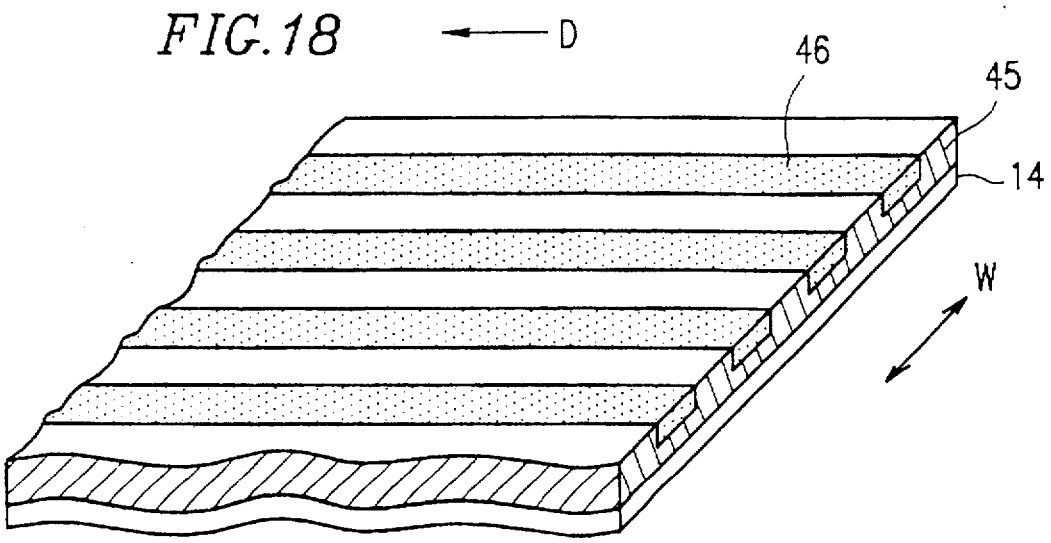
FIG. 18 is a schematic view showing a stripe-shaped coating film formed by using the coating device shown in FIG. 17.

FIG. 18 is a schematic view showing examples of the first and second coating films 45 and 46 formed on the base material 14 by using the coating device 400. Specifically, the first coating film 45 (which serves as a lower layer) is formed on the surface of the base material 14 traveling in the direction of arrow D, and the second coating film 46 is further formed on the first coating film 45 in stripes disposed in the direction of arrow W.

The coating device 400 used herein is such that the curvature radius R of the R face 4 of the front block 7, the distance X1 and the distance X2 shown in FIG. 2, are 30 mm, 1 mm and 2 mm, respectively, and 50 discharging openings 2 each having a rectangular shape (as seen from above) are formed. Each discharging opening 2 has a width dimension of 1 mm and a travelling direction dimension of 200 μm. The base material 14 is a polyethylene telephthalate film having a thickness of 50 μm and a width of 120 mm. A ceramic slurry and a conductive paste are used as the first and second coating materials 43 and 44, respectively.

The stripes of the resultant second coating film 46 shown in FIG. 18 have an average line width of 1 mm, the fluctuation thereof being within the range of ±10 μm. The stripes have an average thickness of 1 μm, the fluctuation thereof being within the range of ±0.02 μm.

Thus, by using the coating device 400, it is possible to form the second coating film 46 as the upper layer in stripes having very uniform line widths and thicknesses on the first coating film 45 serving as the lower layer.

By applying the present example to the production of chip capacitors, it becomes possible to form about 300 multilayer structures laminated onto one another. Thus, large-capacitance chip capacitors can be easily produced.

EXAMPLE 5

Hereinafter, a coating device 500 according to Example 5 of the present invention will be described with reference to FIGS. 19 and 20.

Figure 19:
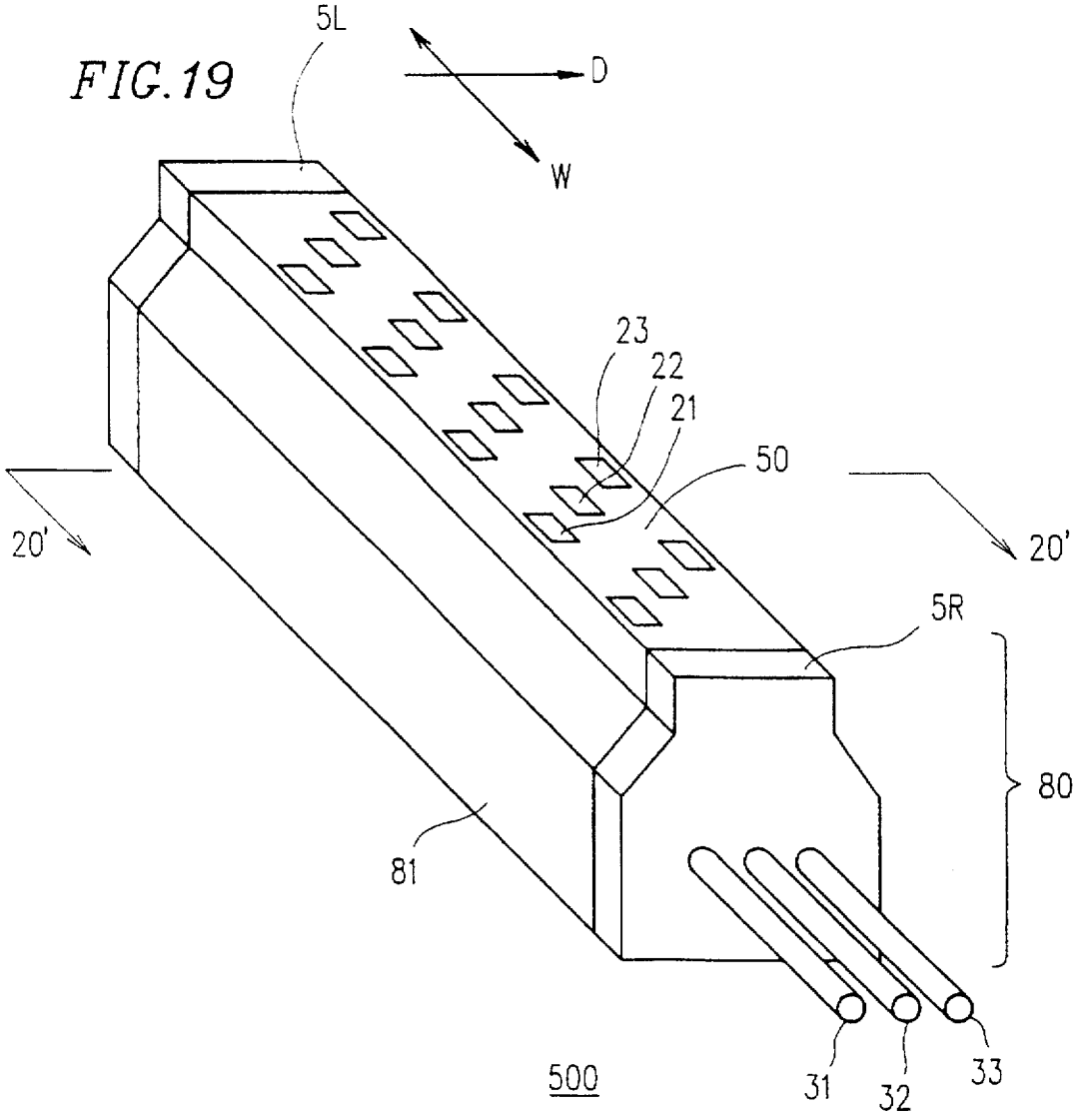
FIG. 19 is a perspective view showing a coating device according to Example 5 of the present invention.
Figure 20:
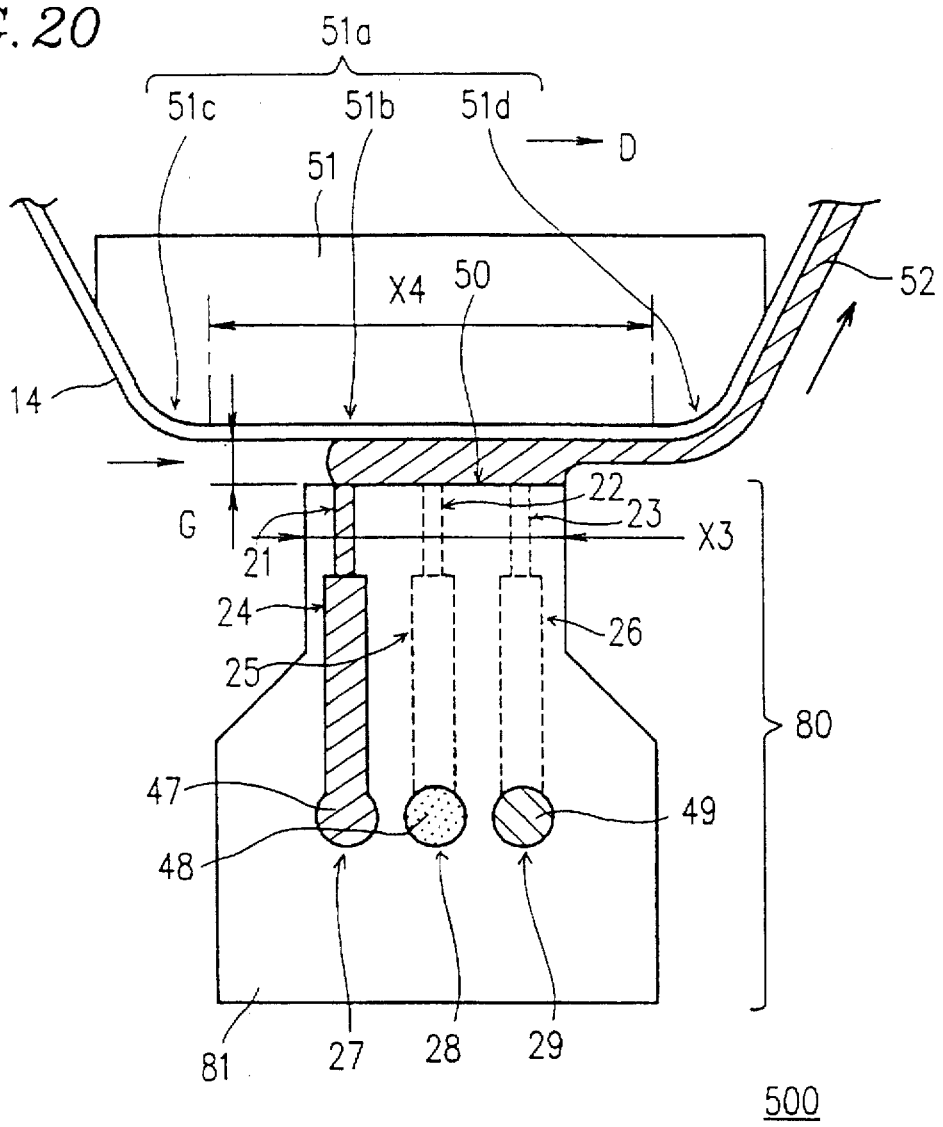
FIG. 20 is a cross-sectional view taken along line 20'—20' in FIG. 19.

FIG. 19 is a perspective view of the coating device 500. FIG. 20 is a schematic cross-sectional view showing the manner coating materials are applied on a surface of a base material 14 by using the coating device 500. Those component elements of the coating device 500 which correspond to the elements in the coating device 200 of Example 2, having the similar function, are indicated by the same references, and the description thereof are omitted. Although the base material 14 is described to travel in the opposite direction in the coating device 500 as compared to the base material in the coating device 200, this does not mean any significant change in the features of the present invention.

A nozzle 80 included in the coating device 500 is composed of a center block 81 and side blocks 5R and 5L. The blocks 81, 5R and 5L are connected to one another by means of screws (not shown). Pipes 31 to 33 are connected to the side block 5R.

The top end of the central block 81 projects toward the base material 14. The top end of the center block 81 is processed into a flat face 50. The flat face 50 is processed so as to have planarity on the order of micrometers within the range of X3 along the direction of arrow D (shown in FIG. 20), in which the base material 14 travels.

The interior of the center block 81 is processed into such a shape as to constitute the first manifold 27, the second manifold 28 and the third manifold 29. First to third slits 24 to 26 are provided above the manifolds 27 to 29, respectively, so as to continuously extend along the application width direction W. A plurality of first to third apertures 21 to 23, running through the flat face 50 from the top ends of the slits 21 to 23, respectively, are provided at predetermined intervals. The first to third apertures 21 to 23 function as discharging openings through which the coating material is discharged. As shown in FIG. 19, the first to third apertures 21 to 23 are provided on the flat face 50 at predetermined intervals, along the application width direction indicated by arrow W.

Specifically, the first to third discharging openings 21 to 23 are arranged on the flat face 50 in three rows along the direction D in which the base material 14 travels. In their respective rows, the discharging openings 21 to 23 are arranged at an equal pitch along the application width direction W. The first apertures 21 in the first row, the second apertures 22 in the second row, and the third apertures 23 in the third row discharge respectively different coating materials, so as to form different stripe-shaped coating films. Therefore, the apertures 21 to 23 are arranged in such a manner that the respective resultant stripe-shaped coating films do not overlap with one another. As a result, it is possible to simultaneously apply three different coating materials on the surface of the base material 14 in accurate stripes not overlapping with one another.

In accordance with the application device 500, a first coating material 47 is provided to the first manifold 27 via the first supply pipe 31 by way of a supply means (not shown) such as a constant pump. Thereafter, the first coating material 47 is thrust into the first slit 24 from the first manifold 27 owing to the pressure while being supplied, and is discharged through the first apertures 21 so as to be applied onto the surface of the traveling base material 14. As a result, a first coating film 52 is formed on the surface of the base material 14 in a predetermined stripe pattern.

Similarly, a second coating material 48 is provided to the second manifold 28 via the second supply pipe 32 by way of a supply means (not shown) such as a constant pump. Thereafter, the second coating material 48 is applied onto the surface of the base material 14 via the second slit 25 and the second apertures 22. As a result, a second coating film is formed on the surface of the base material 14 in a predetermined stripe pattern.

Similarly, a third coating material 49 is provided to the third manifold 29 via the third supply pipe 33 by way of a supply means (not shown) such as a constant pump. Thereafter, the third coating material 49 is applied onto the surface of the base material 14 via the third slit 26 and the third apertures 23. As a result, a third coating film is formed on the surface of the base material 14 in a predetermined stripe pattern.

Thus, in accordance with the coating device 500, the different kinds of coating materials 47 to 49 are discharged via the first to third discharging openings 21 to 23, respectively, so that the first to third coating films are formed side by side on the base material 14.

The coating device 500 further includes a backup plate 51 so as to oppose the flat face 50 at the top end of the nozzle 80. The backup plate 51 is provided in order to ensure that the base material 14 travels along a face 51*a* which opposes the flat face 50 of the nozzle 80. In a region range indicated by a distance X4 along the direction D (shown in FIG. 20) in which the base material 14 travels (this region will be referred to as "the base material-travelling region of the backup plate 51"), the face 51*a* of the backup plate 51 is processed into a flat face 51*b* having planarity on the order of micrometers. Adjacent to the flat face 51*b*, curved faces 51*c* and 51*d* each having an appropriate curvature radius are formed so as to support the traveling base material 14.

The flat face 50 of the nozzle 80 and the flat face 51*b* of the backup plate 51 are disposed to be substantially parallel to each other. The width X3 of the center block 81 running along the traveling direction D of the base material 14 (also referred to as the "base material-travelling region of the flat face 50") is prescribed so as to satisfy relationship of $X4 \geqq X3$. A gap G between the base material 14 and the flat face 50 is prescribed so as to be about twice as large as the thickness of each coating film in a wet state.

In accordance with the coating device 500, three kinds of coating materials discharged via the first to third discharging openings 21 to 23 are applied in stripes on the surface of the base material 14, which travels while being supported by the face 51*a* of the backup plate 51. Since the base material 14 is supported by the backup plate 51, the gap G between the flat face 50 and the base material 14 can be kept constant. Therefore, the coating materials flowing in streaks in the interspace between the base material 14 and the flat face 50 do not have any turbulence. Thus, stable stripeshaped coating films can be formed.

The coating device 500 can be applied to the production of a color filter for liquid crystal display devices. For example, a color filter can be produced by employing the coating device 500 having 500 each of first to third discharging openings 21 to 23 each having a rectangular shape (as seen from above). Each aperture 21, 22 or 23 can suitably have a width dimension of 100 μm and a travelling direction dimension of 75 μm. The first to third apertures 21 to 23 are all arranged at a pitch of 300 μm along the application width direction W. The base material 14 is typically a polyethylene telephthalate film having a thickness of 15 μm and a width of 180 mm. The first to third coating materials 47 to 49 are typically obtained by dispersing red, blue, and green pigments, respectively, into a resin and a solvent.

Thus, a pattern of coating films in stripes having an average line width of 100 μm can be obtained, the fluctuation thereof being within the range of ±2 μm. The stripes have an average thickness of 1 μm, the fluctuation thereof being within the range of ±0.02 μm. The coating films do not overlap with one another along the width direction W.

Thus, by using the coating device 500, it is possible to form coating films of different coating materials in accurate stripe patterns which do not overlap with one another along the width direction, the stripes having very uniform line widths and thicknesses.

By applying the present invention to the production of a color filter of red, blue, and green, a color filter can be obtained such that the surface thereof is flat and that the adjoining color portions closely contact with each other without overlapping. In a printing method, which is a conventional method of producing a color filter, the printed films corresponding to respective pixels of red, blue, and green of the resultant color filter each have a convex cross section. As a result, the central portion and end portions of each pixel have a noticeable difference in color density. In contrast, a color filter produced according to the present example is such that the coating films, which correspond to the respective pixels, are formed with uniform thicknesses, so that the central portion and end portions of each pixel have very little difference in color density. As a result, the product performance of the color filter remarkably improves.

A conventional color filter requires a post-production process, e.g., flattening the surface thereof, in order to eliminate the above-mentioned problem due to the cross sections of the resultant coating films. The color filer in accordance with the present example does not require such post-production processes. Furthermore, according to the present example, it is possible to simultaneously form stripes in three colors by using a single nozzle. As a result, the facility cost can be reduced and the production process can be simplified. Thus, by applying the present example of the invention to the production of a color filter, the production cost of the color filter can be reduced.

In the above explanation, the coating device 500 is described to be capable of applying three different kinds of coating materials. However, the present example is not limited to that number of coating materials. It would be easy for one skilled in the art to modify the coating device 500 so as to be capable of applying two different kinds of coating materials or, alternatively, four or more kinds of coating materials on a base material in order to form stripe patterns of the respective coating films.

The nozzle 80 is composed of the center block 81 and the side blocks 5R and 5L in Example 5. Alternatively, it is applicable to compose the center block 81 of a combination of a plurality of blocks, as in the case of the back block 8 of the coating device 200 of Example 2, which is composed of a combination of the first to third back blocks 18 to 20. In that case, the manifolds and slits inside the center block 81 can be accurately formed by plane grinding, as in the other examples of the invention.

Thus, in accordance with the coating device of the present invention, a nozzle for discharging a coating material includes a front block and a back block. The front block is located upstream of the travelling direction of a base material, and the back block is located downstream of the travelling direction of the base material. The front block of the nozzle projects toward the base material relative to the back block. By allowing the base material to travel along the surface of such a nozzle, the base material first travels along a curved face of the nozzle. Then, the base material travels above the back block of the nozzle, in which discharging openings for the coating material are provided. Thus, no plane pressure from the base material is applied to the coating material discharged through the discharging openings. Therefore, the discharged coating material does not spread along the application width direction owing to plane pressure, so that a stable stripe-shaped coating film can be applied onto the surface of the base material, the width of each stripe not fluctuating from the width direction dimension of each discharging opening. The above-mentioned advantage can be particularly enhanced by allowing the base material to travel substantially in parallel to a flat face of the back block, or at an angle within ±10°.

By allowing the base material to travel along the curved face of the front block, the wrinkles and creases on the surface of the base material can be removed, thereby making the surface flat. By applying a coating material onto the base material having such a flat surface, the line widths and thicknesses of the stripes of the resultant coating film can be controlled to stay at the prescribed values.

Furthermore, by proving a slit also in the front block, it becomes possible to first discharge a first coating material through the slit of the front block so as to form a first coating film to serve as a lower layer, and then discharge a second coating material through the discharging openings of the back block so as to form a stripe-shaped second coating film on the first coating film. Thus, a multilayered structure of coating films can be easily and efficiently formed. The width of each stripe of the second coating film does not fluctuate from the width direction dimension of each discharging opening, thereby forming a stable pattern.

By respectively prescribing the respective appropriate ranges for the curvature radius of the curved face of the front block, the distance between the flat face of the back block and the traveling base material, and the relative positions of the discharging openings on the flat face of the back block, the stability of the line widths of the stripes of the resultant coating film(s) can be further improved.

In particular, by prescribing the distance X1 from the end face of the front block, which is closer to the back block, to the nearest brim of each discharging opening to be within the range of 0.005 mm to 10 mm, the discharged coating material(s) is prevented from contacting the end face of the front block so as to smear over that portion and increase the line widths. Moreover, the effect of flattening the base material due to the elimination of wrinkles and creases can be maintained. This contributes to the improvement in the stability of the line widths of the resultant stripes.

By providing a plurality of discharging openings corresponding to a plurality of coating materials, it becomes possible to discharge different coating materials from the respective discharging openings. As a result, stripes of coating films, such that different coating films are arranged side by side in stripes, can be formed in substantially one step.

In the case where a slit is also provided in the front block, it can be ensured that the base material travels along the curved top face of the front block while retaining a predetermined distance between the curved face and the base material above the front block, and further that the base material travels, above the back block, at an angle within ±10°, or substantially in parallel, with the flat face, instead of forming the front block so as to project toward the base material. In such a configuration, a first coating material is first discharged through the slit of the front block so as to form a first coating film (to serve as a lower layer) on the surface of the base material. Next, the second coating material is discharged through the discharging openings of the back block. Thus, a second coating film can be formed in stripes buried in the first coating film. In this case, too, a multilayered structure of coating films can be formed easily and efficiently, with the width of each stripe of the second coating film not fluctuating from the width direction dimension of each discharging opening so as to form a stable pattern. Furthermore, the base material and the curved face do not directly contact with each other, so that the travelling rate of the base material does not fluctuate due to any friction resistance therebetween. As a result, the stripe pattern can be formed even more stably.

Furthermore, by providing a backup member so as to oppose the flat face of the nozzle and lie substantially in parallel to the flat face, so that the backup member supports the traveling base material, it becomes possible to keep constant the gap between the flat face of the nozzle (in which the discharging openings for discharging the coating materials are provided) and the traveling base material. As a result, no plane pressure is applied from the base material to the coating material(s) discharged through the discharging openings, so that coating materials flowing in streaks in the interspace between the base material and the flat face do not have any turbulence. Thus, the width of each stripe of coating material is prevented from fluctuating, thereby providing stable stripe-shaped coating films with little fluctuation in the line widths thereof.

Thus, in accordance with the coating device and the coating method according to the present invention, it is possible to accurately form a coating film in a stripe pattern having a predetermined stripe width. The line widths of the stripes are prevented from fluctuating. Furthermore, the thickness of the coating film can be controlled to stay at a predetermined value.

Accordingly, in the pattern-formation process required in electronic parts, such as the formation of color filters for liquid crystal display devices, the formation of an electrode pattern of multilayered ceramic chip capacitors or the like, the product performance and quality can be improved, while greatly reducing the production cost.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for forming a coating film in a predetermined pattern by applying a coating material from a nozzle to a surface of a base material which continuously travels, the nozzle comprising:

a front block provided upstream with respect to a traveling direction of the base material, a top face of the front block which faces the traveling base material being a curved face which has a predetermined curvature radius; and a back block provided downstream with respect to the traveling direction of the base material, a top face of the back block which faces the traveling base material being a flat face, wherein the front block is provided so as to project toward the base material with respect to the back block, and a plurality of discharging openings are provided on the flat face of the back block for discharging the coating material therethrough, wherein the method comprises the steps of:

making the base material travel along the curved face of the front block;

making the base material travel over the flat face of the back block at an angle in the range of ±10° with respect to the flat face; and discharging the coating material through the plurality of discharging openings so as to apply the coating material on the base material without contacting the coating material with the front block.

2. A method according to claim 1, further comprising the step of discharging a first coating material through a slit provided in the front block to form a first coating film, wherein in the step of discharging the coating material through the plurality of discharging openings, a second coating film is formed on the first coating film.

3. A method according to claim 1, wherein the base material travels substantially in parallel with the flat face of the back block.

4. A method according to claim 1, wherein the plurality of discharging openings provided in the flat face of the back block include a first, second and third discharging openings, and in the step of discharging the coating material through the plurality of discharging openings, a first coating material is discharged through the first discharging opening, a second coating material is discharged through the second discharging opening and a third coating material is discharged through the third discharging opening so as to form a first through third coating films on a surface of the base material.

5. A method for forming a coating film in a predetermined pattern by applying a coating material from a nozzle to a surface of a base material which continuously travels, the nozzle comprising:

a front block provided upstream with respect to a traveling direction of the base material, a top face of the front block which faces the traveling base material being a curved face which has a predetermined curvature radius, the front block including a slit extending continuously in a width direction of the base material and discharging a first coating material therethrough; and a back block provided downstream with respect to the traveling direction of the base material, a top face of the back block which faces the traveling base material being a flat face, a plurality of discharging openings being provided on the flat face for discharging a second coating material therethrough, wherein the method comprises the steps of:

making the base material travel, above the front block, along the curved face of the front block while retaining a predetermined distance between the base material and the curved face, and discharging the first coating material through the slit provided in the front block to form a first coating film;

making the base material travel over the back block at an angle in the range of ±10° with respect to the flat face of the back block, and discharging the second coating material through the plurality of discharging openings to form a second coating film on the first coating film.

6. A method according to claim 5, wherein the base material travels substantially in parallel with the flat face of the back block.

* * * * *